US005603537A

United States Patent [19]

Amano et al.

[11] Patent Number: 5,603,537

[45] Date of Patent: Feb. 18, 1997

[54] DOOR-LOCK DRIVING SYSTEM

[75] Inventors: Hitoshi Amano; Takashi Kobayashi, both of Okazaki, Japan

[73] Assignee: Nippondenso co., Ltd., Kariya, Japan

[21] Appl. No.: 426,844

[22] Filed: Apr. 24, 1995

[30] Foreign Application Priority Data

May 13, 1994 [JP] Japan ..... 6-100189
Mar. 13, 1995 [JP] Japan ..... 7-52503

[51] Int. Cl.[6] ..... E05C 3/06

[52] U.S. Cl. ..... 292/201; 292/DIG. 23; 70/264

[58] Field of Search ..... 292/201, DIG. 23; 70/264

[56] References Cited

U.S. PATENT DOCUMENTS

| | | | |
|---|---|---|---|
| 4,342,209 | 8/1982 | Kleefeldt . | |
| 4,364,249 | 12/1982 | Kleefeldt | 292/DIG. 23 |
| 4,452,058 | 6/1984 | Noel | 70/264 X |
| 4,502,718 | 3/1985 | Sasaki et al. | 292/201 |
| 4,519,227 | 5/1985 | Dumbser et al. . | |
| 5,066,054 | 11/1991 | Ingenhoven | 292/201 |
| 5,240,296 | 8/1993 | Kobayashi | 292/201 |
| 5,409,277 | 4/1995 | Rogers, Jr. et al. | 292/201 X |

FOREIGN PATENT DOCUMENTS

| | | |
|---|---|---|
| 2261179 | 10/1990 | Japan . |
| 384181 | 4/1991 | Japan . |

*Primary Examiner*—Rodney M. Lindsey
*Attorney, Agent, or Firm*—Cushman, Darby & Cushman IP Group of Pillsbury Madison & Sutro LLP

[57] ABSTRACT

After a door is super-locked by an electric motor, the door cannot be unlocked by a manual control knob for passenger's safety and for burglarproof. The door-lock unit and other components including the electric motor and a door-lock unit are protected from a violent force applied on the knob or some other components even if an inappropriate attempt to open the door in such occasion. In the actuator, an output lever which is connected to the door-lock unit rotatably disposed on an input lever which is connected to the knob. A clutch lever is connected to the torque transmitting mechanism and is rotatably disposed on the output lever. When the door is super-locked, the output lever is retained by a stopper, and only the clutch lever is rotated counter-clockwise so that the clutch arm disengages from the input lever. As a result, even if the knob is drawn forcibly to unlock the door, only the input lever is rotated as the knob is moved and no violent force is applied on the door-lock unit or the electric motor.

14 Claims, 23 Drawing Sheets

FIG. 4
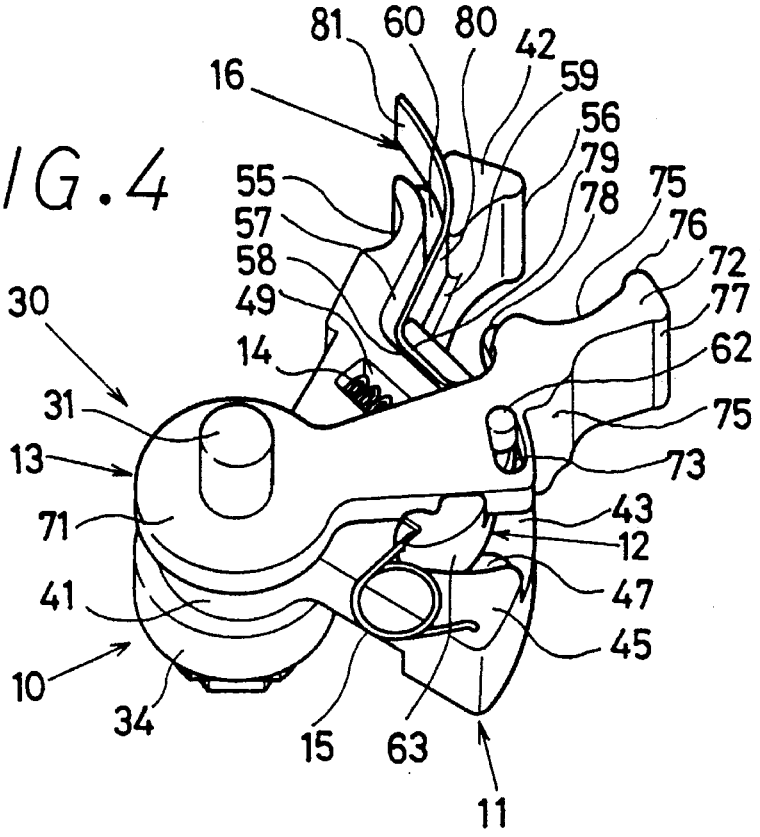
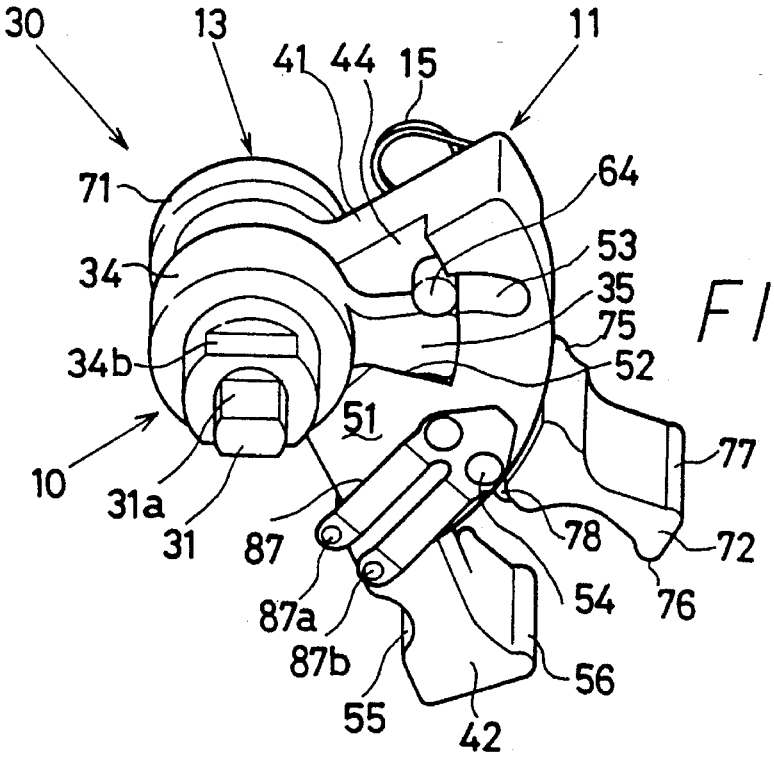
FIG. 6

DOOR-LOCK DRIVING SYSTEM

CROSS REFERENCE TO RELATED APPLICATION

The present application is based on and claims priority from Japanese Patent Applications Nos. Hei 6-100189 filed on May 13, 1994 and Hei 7-52503 filed on Mar. 13, 1995.

BACKGROUND OF THE INVENTION

1. Field of the Invention

The present invention relates to a door-lock driving system in which door is prevented from being unlocked by a knob when the door has been locked by an electric motor-driven unit.

2. Description of the Related Art

As prior art door-lock driving devices, there are Japanese Patent Application Laid Open No. Sho 58-176374 and Japanese Patent Application Laid Open No. Hei 3-84181. The conventional devices include a knob, a door-lock unit which mechanically carries out a locking or unlocking of a door, a torque transmitting member which operates the door-lock unit, a first electric motor which drives the transmitting unit according to the position of a key inserted into a key switch and a second electric motor which holds a push rod when the door is locked.

However, in the conventional devices, if a great force is applied to the knob after the door has been locked by an actuator in order to unlock the door forcibly while the second electric motor is holding the push rod, the door-lock unit and the second electric motor may suffer damage.

SUMMARY OF THE INVENTION

The present invention is made in view of the foregoing problems, and has a primary object of providing an improved door-lock driving system which can prevent a door from being manually unlocked when the door has been locked by a motor-driven unit, thereby protecting the vehicle from a theft.

A second object of the present invention is to provide a door-lock driving system in which an interlocking of the door-lock unit, the actuator and the knob during the super-locking state is released and they are protected from damage.

Another object of the present invention is to provide a door-lock driving system in which the linkage of the knob, the actuator and the door-lock unit is controlled by a single electric motor.

Another object of the present invention is to provide a door-lock driving device which prevents malfunction of a clutch lever and erroneous shifting of an actuator into the super locking state—the state where the manual unlocking operation is not possible—when the actuator is being shifted from the unlocking state to the ordinary locking state.

Still another object of the present invention is to provide a door-lock driving system in which an actuator includes a single electric motor, a torque transmitting member which transmits the motor torque, a first lever which has a tongue and is connected to a knob, a second lever which drives the door-lock unit and a clutch mechanism which has a clutch arm, a clutch lever and a snap member and interlocks the first and second levers when the actuator is in the unlocking state or in the ordinary locking state and releases the interlocking when the actuator is shifted from the ordinary locking state to the super locking state.

When a shifting of the first locking state to the super-locking state is initiated, the locking torque of the electric motor is transmitted to the clutch lever and the clutch arm, which is driven by the snap member to separate from the tongue and the first lever, the second lever and the clutch lever are released from the interlocked state. During the super-locking state, even if the knob is driven to carry out the door unlocking state forcibly, the door-lock unit does not operate to unlocking the door. Further, since an excessive force is not applied on components such as the door-lock unit, the torque transmitting member, the electric motor, etc., such components do not suffer damage. Since the clutch arm does not disengage from the tongue of the first lever when shifting from the unlocking state to the first locking state is carried out, erroneous shifting to the super-locking state is completely prevented.

A further object of the present invention is to provide a door-lock driving system in which an actuator includes an unlocking-side stopper engageable with the clutch lever when the actuator is in the unlocking state, and a locking-side stopper engageable with the second lever when the actuator is in the ordinary locking state. When a shifting is made from the unlocking state to the ordinary locking state and when the second lever engages the locking-side stopper corresponding to the first locking state, the electric motor is deenergized. Thereby, the rotation of the second lever in the locking direction stops and the second lever remains in the ordinary locking state of the actuator.

A further object of the present invention is to provide a door-lock driving system which includes a movable contact secured to the back of the second lever, a stationary contact disposed in the case to face the movable contact so that the electric motor is deenergized when shifting is carried from the unlocking state to the ordinary locking state and the second lever is in abutment with the locking-side stopper.

A still further object of the present invention is to provide a door-lock driving system in which an actuator includes a locking-side stopper engageable with the second lever during the normal locking state, a projection formed on a periphery of the second lever, a switch for energizing the electric motor when it abuts said projection. The switch deenergizes the electric motor when the door is shifted from the unlocking state to the ordinary locking state and the second lever engages the locking-side stopper.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

FIG. 4 is a perspective view illustrating the clutch mechanism shown in FIG. 1;

FIG. 6 is a perspective view illustrating the clutch mechanism shown in FIG. 1;

DETAILED DESCRIPTION OF THE PREFERRED EMBODIMENT

Preferred embodiment according to the present invention will now be described with reference to the appended drawings. Next, door-lock driving systems according to a plurality of embodiments of the present invention will be explained.

Figure 1:
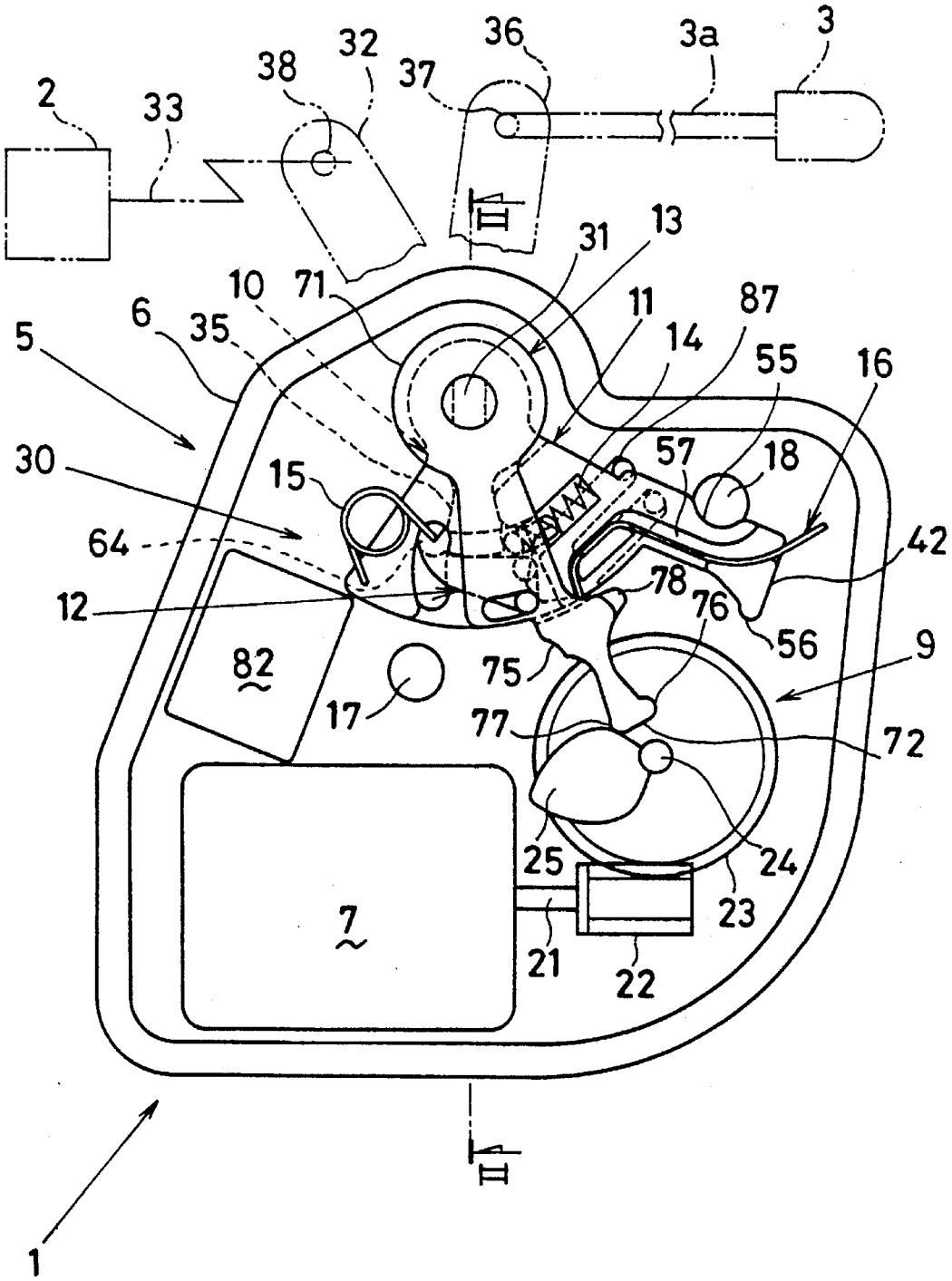
FIG. 1 is a plan view illustrating an actuator of a door-lock driving unit according to a first embodiment of the invention.
Figure 2:
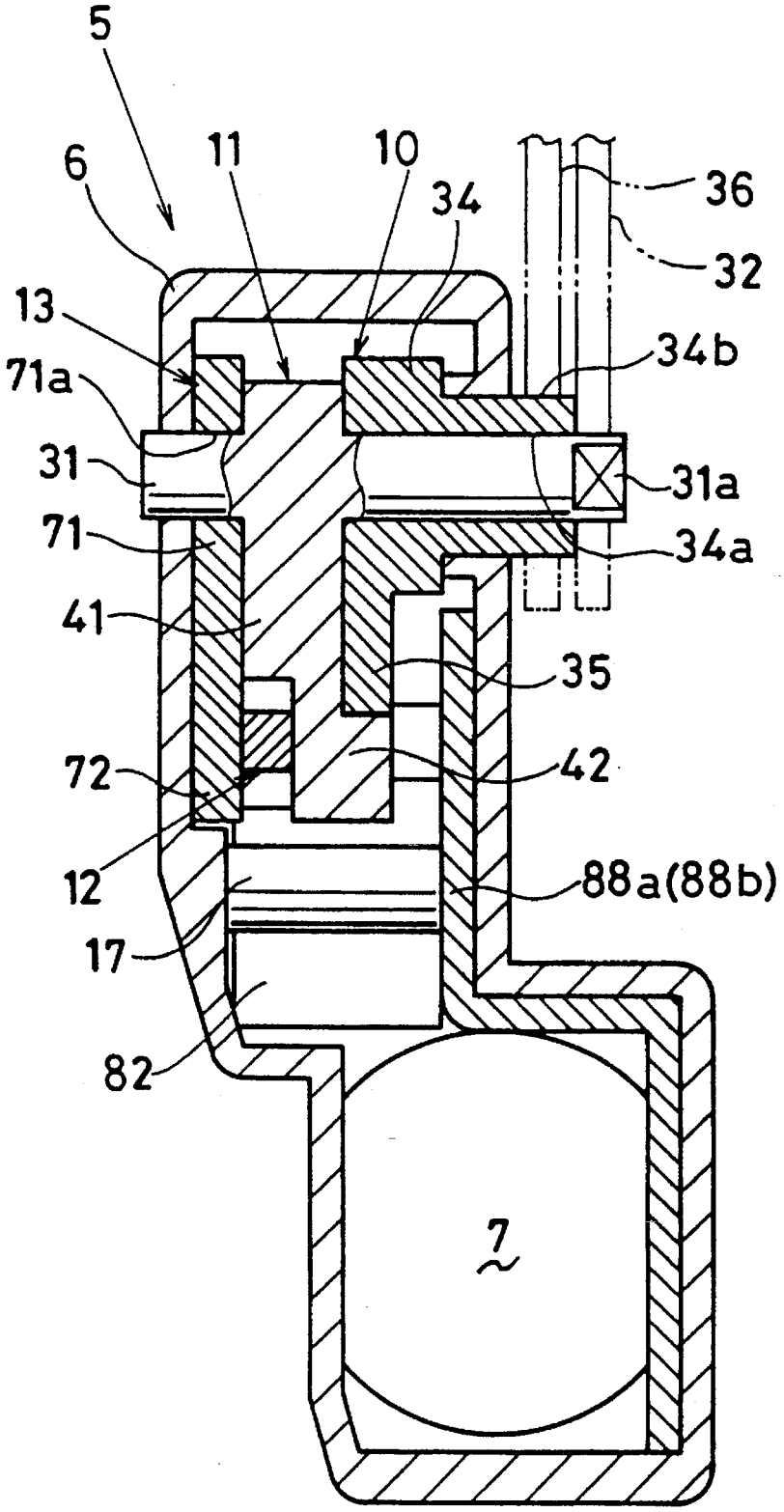
FIG. 2 is a cross-sectional view taken along line II—II of FIG. 1.
Figure 3A:
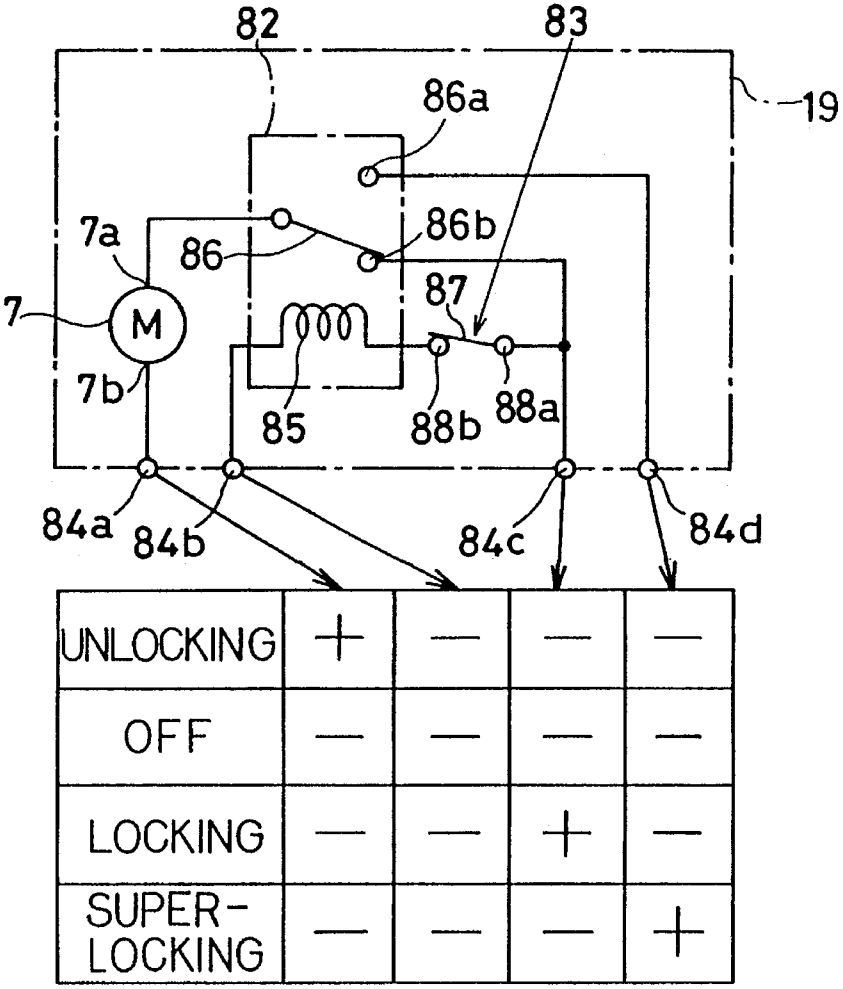
FIG. 3A is an electric circuit diagram illustrating a motor energizing circuit of the actuator shown in FIG. 1.
Figure 3B:
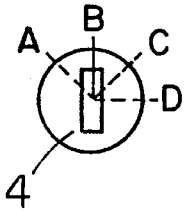
FIG. 3B is a front view illustrating a key switch.

FIGS. 1 through 15 illustrate a first embodiment according to the present invention. FIG. 1 and FIG. 2 illustrate an overall view of a door-lock driving system for a vehicle, and FIG. 3 illustrate a key switch and a motor driving circuit. Positions A,B,C,D for the key switch in FIG. B (and also 29*b*, 32*b* and 33*b*) represent respectively the positions of unlocking, off, locking and super-locking.

The door-lock driving system for a vehicle 1 is equipped with a door-lock unit 2 which locks and unlocks the driver's door of a vehicle, a knob 3 which is manually operated when the door-lock unit 2 is being locked or unlocked inside the vehicle, a key switch 4 which is operated when the door is being locked or unlocked from the outside of the vehicle and an actuator 5 which operates the door-lock unit 2 according to a change-over signal from a signaling member such as a vehicle speed sensor, centralized manual door-lock switches (not shown) and a remote control door-lock switch (not shown).

The door-lock unit 2 is secured to a portion between an outer panel (not shown) and an inner panel (not shown) of the driver's door. The door-lock unit 2 engages a striker(not shown) and has two designated positions: door-unlocking position and door-locking position.

The key switch 4 and the centralized door-lock switches send the actuator 5 an electric signal to carry out door-unlocking state, a first or ordinary locking state in which doors may be unlocked by manually operating the knob 3, or a second locking or super-locking state in which doors may not be unlocked by manually operating the knob 3. The centralized door-lock switches control the actuator 5 to toggle between unlocking and locking all the doors or between unlocking and locking all the doors except the driver's door when an unlocking button or a locking button of the switches is manually operated.

When the door is being unlocked, the key is inserted into the key cylinder of the key switch 4 and turned to the door-locking position. When the super-locking is being carried out, the key 4 is turned from the locking position further to the super-locking position as illustrated in FIG. 3. However, it is possible to carry out the super-locking state by turning the key one time to the locking position, turning the key back to the off position and, thereafter, turning to the super-locking position.

The key switch 4 mechanically operates the door-lock unit 2 for the driver's door corresponding to the key position. The door-lock units 2 for the doors (such as a front passenger's door, rear doors, a slide door, or a back door) other than the driver's door have no mechanical connection with the key switch 4. They are operated by each actuator according to the signal for the unlocking, the locking or the super-locking. By the way, it is possible to arrange the key switch 4 of the front passenger's door so that it sends a signal of the unlocking, the locking or the super-locking to each door (such as the driver's door, the rear doors, the slide door, and the back door).

The knob 3 is inserted and secured in the inner panel of the driver's door so as to slide up and down therein. The knob 3 has the following two operational positions: an unlocking position where the actuator 5 causes the door-lock unit 2 to be in the door-unlocking position and a door-locking position where the actuator 5 causes the door-lock unit 2 to be in the door-locking position.

A rod 3*a* which is smaller in diameter than the knob 3 is connected to the bottom of the knob 3 at one end and installed slidably between the outer panel and the inner panel of the driver's door. The other end of the rod 3*a* is fitted into an opening 37 formed in a knob lever 36.

The structure of the actuator 5 will be described below in detail with reference to FIG. 1 through FIG. 15.

The actuator 5 is fixed between the outer panel and the inner panel of the driver's door and drives the door-lock unit 2 to lock or unlock doors. A case 6 of the actuator is composed of an upper case and a lower case and accommodates an electric motor 7, a torque transmitting mechanism 9, clutch mechanism 30 and a motor driving circuit 19 and others.

As shown in FIG. 8 through FIG. 15, the actuator according to this embodiment has three operating states: unlocking state to operate the door-lock unit 2 to be in the unlocking position, a first locking state to operate the door-lock unit 2 to be in the ordinary locking position where the knob 3 is manually operated to unlock the doors and a second locking state where the door cannot be unlocked by manual operation of the knob 3.

The electric motor 7 is a motor such as a stepping motor or a servomotor, and is energized to drive the torque transmitting mechanism 9 according to a signal from the key switch 4 or a signal according to a set state of the signal generating member such as a speed sensor, centralized door-lock switches or a remote control door-lock switch. The electric motor 7 has a pinion 22 fixed on its output shaft 21.

The torque transmitting mechanism 9 is composed of an intermediate gear 23 in engagement with the pinion 22 and a cam 25 formed integral with a rotary shaft 24 of the intermediate gear 23. The cam 25 extends radially outward from the rotary shaft 24.

In the torque transmitting mechanism 9, when the cam 25 rotates counterclockwise, the clutch mechanism 30 of the actuator 5 is caused to establish the unlocking state, and when the cam 25 rotates clockwise, the clutch mechanism 30 of the actuator 5 is caused to establish the first locking state or the second locking state (super-locking state).

FIG. 4 through FIG. 7 illustrate the clutch mechanism 30 of the actuator 5. The clutch mechanism 30 is composed of a input lever (first lever) 10, an output lever (output lever) 11, a clutch arm 12, a clutch lever 13, a return spring 14, a snap spring 15, a stopper spring 16, an unlocking-side stopper 17 and a locking-side stopper 18.

The input lever 10 is a mold of a resinous material and rotates around a pivot 31 which is disposed in the case in parallel with the rotary shaft 24. The pivot 31 is inserted into the output lever 11 and rotatably supported by the case 6. A groove 31*a* is formed on the pivot at its end extending from the case to connect with a rocking lever 32 as shown in FIG. 2. The rocking lever 32 has a fastening hole 38 at an end which is connected to an end of a joint 33. The other end of the joint 33 is connected to the door-lock unit 2.

The input lever 10 has two operational positions (turning position): an unlocking position corresponding to the unlocking position of the knob 3 and a locking position corresponding to the locking position of the knob 3. The output lever 10 has an annular base portion 34 which is rotatably supported by the pivot 31 and a tongue 35 which is thinner than the base portion 34 and extends from the pivot 31 radially outward.

The base portion 34 has an annular center hole 34*a* which receives the pivot therein. The back of the base portion 34 bulges from the tongue 35 and extends in the axial direction of the pivot 31. A fastening groove 34*b* is formed at the end of the base portion 34 extending from the case 6 and connected to the knob lever 36. A sliding surface is formed at the front surface of the base portion 34, where the output lever 11 rotates.

The output lever 11 is a mold of a resinous material and rotates on the axis of the pivot 31. The output lever 11 has two operational positions (turning position): an unlocking position corresponding to the unlocking position of the door-lock unit 2 and a locking position corresponding to the locking position of the door-lock unit 2.

The output lever 11 has a sector base potion 41 which has the pivot 31 insert-molded therewith and an elongation 42 extending from the outer periphery of the base portion 41 radially outside the pivot 31. A designated-shaped slide hollow 43 is formed on the surface of the base portion 41 so that the clutch arm 12 slides in the hollow 43, and a sector slide hollow 44 is formed on the back surface of the base portion 41 so that the input lever 10 slides in the hollow 44.

Figure 5:
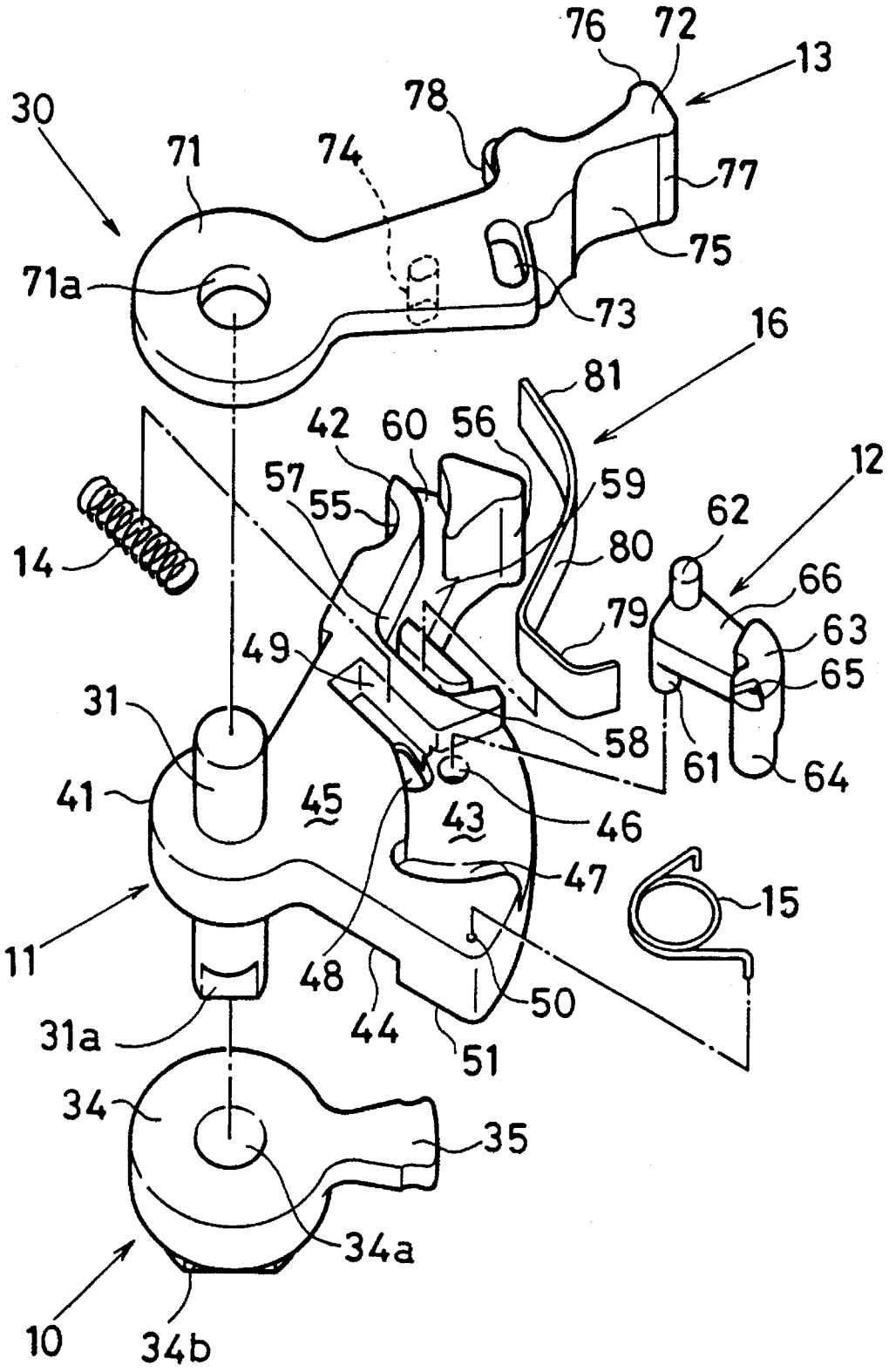
FIG. 5 is an exploded perspective view illustrating the clutch mechanism shown in FIG. 1.

The slide hollow 43 is formed, as shown in FIG. 5, on a portion which is thinner than a bulged portion 45 formed on the surface of the output lever 11. On the slide hollow 43, there are a support hole 46 which rotatably receives the clutch arm 12, an elliptic hole 47 which defines the sliding range of the clutch arm 12, a restricting hole 48 which defines the turning angle of the clutch lever 13 relative to the output lever 11, and a receiving groove 49 which accommodates a return spring 14 therein. The elliptic hole 47 connects the front and the back of the base portion 41 and is shaped into an arc which has the center on the axis of the supporting hole 46. The unlocking-side portion (right side of the output lever 11 illustrated in FIG. 5) of the bulged portion 45 has a supporting through hole 50 which supports one end of a snap spring 15.

Figure 7:
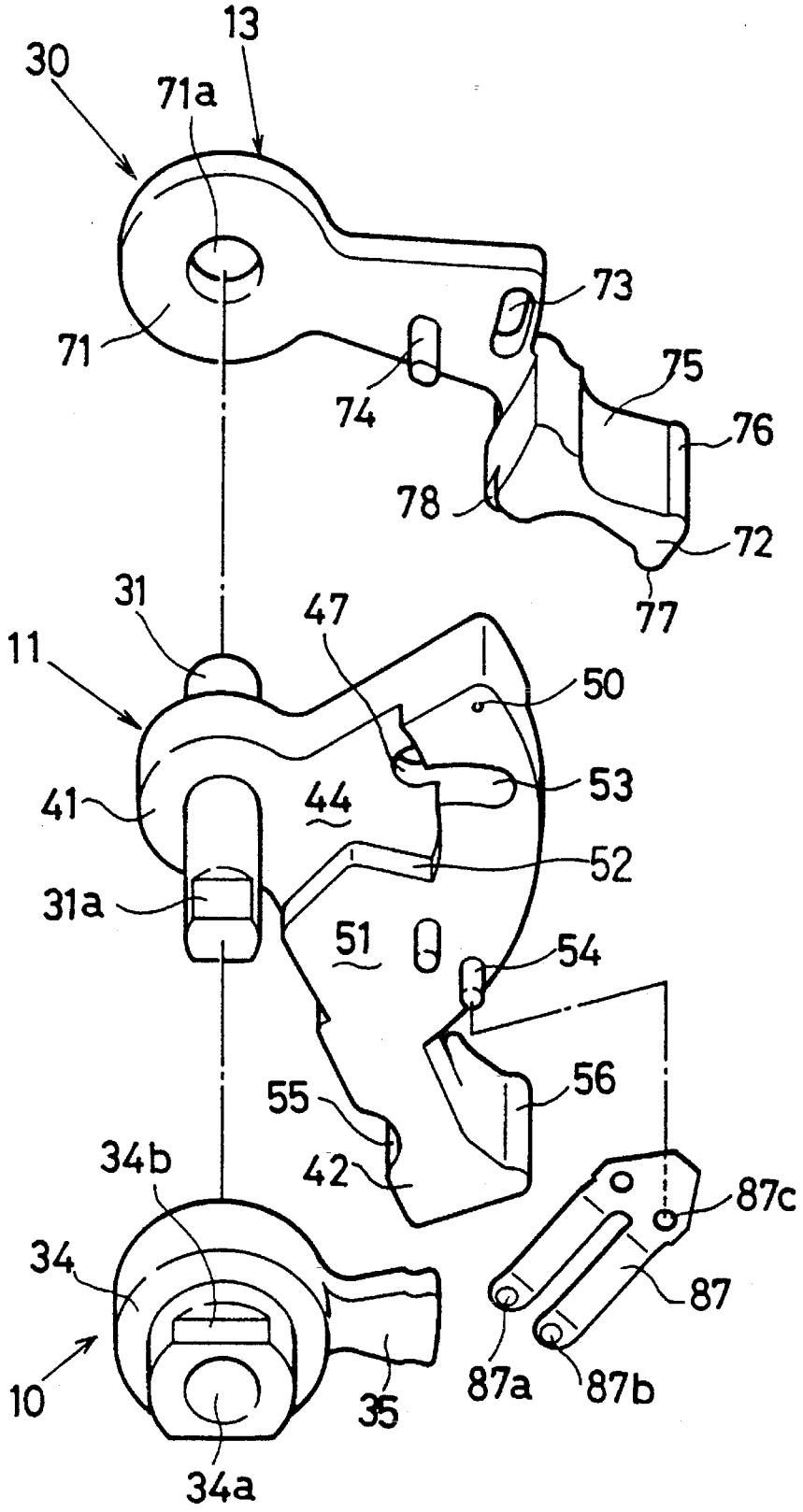
FIG. 7 is an exploded perspective view illustrating the clutch mechanism shown in FIG. 1.

As illustrated in FIG. 7, the slide hollow 44 is thinner than a bulged portion 51 on the back of the output lever 11. On a vertical wall of the bulged portion 51 facing the locking side (right side or down side of the slide hollow 44 illustrated in FIG. 7) portion of the sliding groove 44, there is formed an engaging portion 52 which engages locking portion of the tongue 35 of the input lever 10 when the input lever 10 rotates along with the output lever 11. The radially inner periphery of the bulged portion 51 is formed into an arc along the outer periphery of the input lever 10. On the inner periphery which corresponds to the elliptic hole 47 of the bulged portion 51, an escape hole 53 is formed so that the clutch arm 12 can separate from the input lever 10. On the bulged portion 51, two projections 54 are disposed in parallel with one another and extend in an axial direction of the pivot to retain a switching spring 87 of the motor energizing circuit 19.

The elongation 42 receives the unlocking torque of the electric motor 7 through the cam 25. A semicircular engagement recess 55 is formed on the locking-side surface of the elongation 42 and is engaged with a locking-side stopper 18 when the output lever 11 turns from the unlocking position to the locking position. A projection 56 is formed at one end of the elongation 42, and abuts the cam 25 when the output lever 11 turns from the unlocking position to the locking position. The projection 56 extends to the unlocking-side of the output lever 11 in the rotating direction.

On the front surfaces of the base potion 41 and the elongation 42, a receiving groove 57 is formed to accommodate the stopper spring 16 as shown in FIG. 5. In the receiving groove 57, a fastening groove 58 is formed on an outer periphery of the bulged portion 45 of the base portion 41, a window 59 is formed on the unlocking-side portion of the elongation 42 and a fastening groove 60 is formed at an outer periphery of the bulged portion 45 of the elongation 42.

The clutch arm 12 is a mold of a resinous material, and is pivotally disposed between the front surface of the output lever 11 and the back of the clutch lever 13. The clutch arm 12 has a cylindrical pin 61 formed on the back of the output lever 11, a cylindrical pin 62 which engages the clutch lever 13 (as described later) and a rocking portion 63 rocking around the pin 61. The pin 61 is pivotally carried by the supporting hole 46 of the output lever 11. By the way, the pin 61 may be replaced by a hole. In this case, a projection would be provided on the surface of the output lever 11.

The rocking portion 63 extends in a direction in parallel with the pivot 31. Opposite the rocking portion 63, a cylindrical unlocking member 64 is formed to engage the unlocking portion of the tongue 35 when the clutch lever 13 is placed in the unlocking position or in the locking position as shown in FIG. 6. The unlocking member 64 passes through the elliptic hole 47 and extends from the slide hollow 44 so that it can rock on the same plane as the tongue of the input lever 10. A receiving hole 65 is formed at the front surface of the rocking portion 63 to retain the other end of the snap spring 15 (FIG. 5). The rocking portion 63 and the pins 61 and 62 are connected by a flat connecting portion 66 which is slidably placed on the surface of the slide hollow 43 of the output lever 11 and on the back surface of the clutch lever 13.

The clutch lever 13 is a mold of a resinous material and is carried rotatably by the pivot 31. The clutch lever 13 slides on the surface of the bulged portion 45 of the output lever 11 and on the surface of the connecting portion 66 of the clutch arm 12. The clutch lever 13 has three rotational positions (turning positions): an unlocking position corresponding to the unlocking state of the torque transmitting mechanism 9, a first locking position (ordinary locking position) corresponding to the locking state of the torque transmitting mechanism 9, and a second locking position (super-locking position) corresponding to the super locking state of the torque transmitting mechanism 9. The clutch lever 13 is placed on top of the output lever 11 and has a base member 71 rotatably carried by the pivot 31 and an elongation 72 which extends from the outer periphery of the base member 71 in the radially outside direction of the pivot 31 and is thicker than the base member 71.

Figure 8:
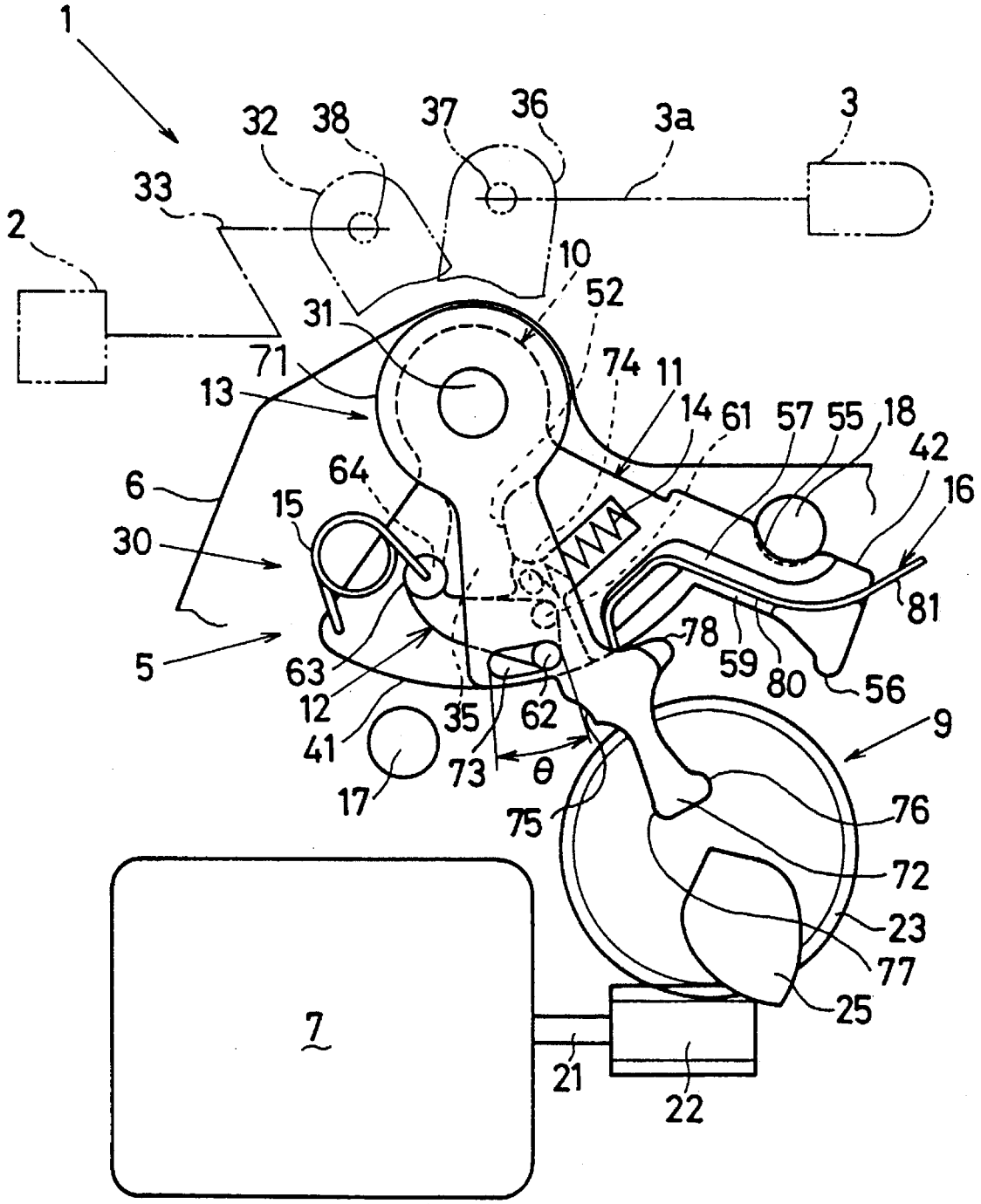
FIG. 8 is a plan view illustrating the actuator shown in FIG. 1 in the locking state.

The base member 71 is flat and has a through hole **71*a* receiving the pivot 31 therein and an elliptic opening 73 which is engaged with the pin 62 of the clutch arm 12. The clutch lever 13 drives the clutch arm 12 in a direction that the unlocking member 64 engages the unlocking portion of the tongue 35 when the pin 62 of the clutch arm 12 engages the locking end of the elliptic opening 73 as shown in FIG. 8**.

Figure 12:
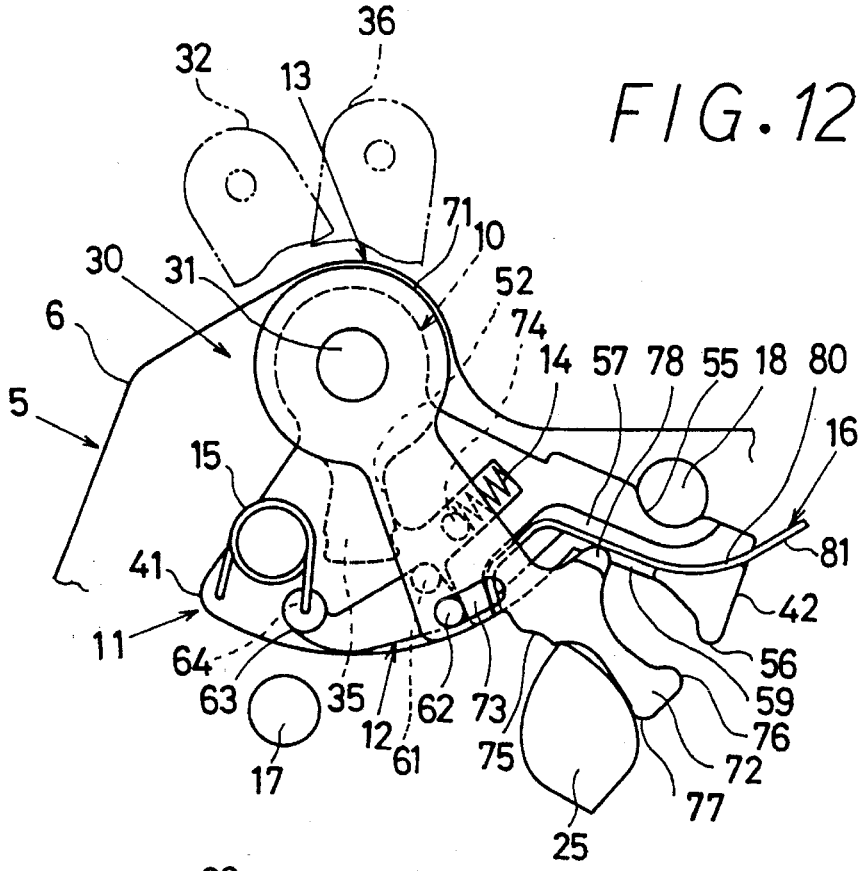
FIG. 12 is a plan view illustrating the actuator shown in FIG. 1 in the super-locking state.

The clutch lever 13 drives the clutch arm 12 in the direction that the unlocking member 64 separates the unlocking portion of the tongue 35 when the pin 62 of the clutch arm 12 engages the unlocking end of the elliptic opening 73 as shown in FIG. 12.

By the way in this embodiment, a marginal angular gap θ° (the marginal rotational gap of the clutch lever 13 relative to the output lever 11) is formed in the portion where the pin 62 of the clutch arm 12 and the elliptic opening 73 of the clutch lever 13 are in engagement.

An approximately cylindrical pin 74 (FIG. 7) projects from the portion on the back of the base portion 71 between the through hole **71*a* and the elliptic opening 73 of the clutch lever 13, and is received by the restricting groove 48 of the output lever 11**.

The elongation 72 receives the unlocking torque and the locking torque of the electric motor 7 through the cam 25. The elongation 72 has approximately the same thickness as the base portion 41 so that the back of the base portion 71 and the elongation 72 enclose the outer periphery of the base portion 41. On the unlocking side of the elongation 72, a semicircular stop recess 75 which engages the unlocking-side stopper 17 when the clutch lever 13 turns in the unlocking direction.

Figure 15:
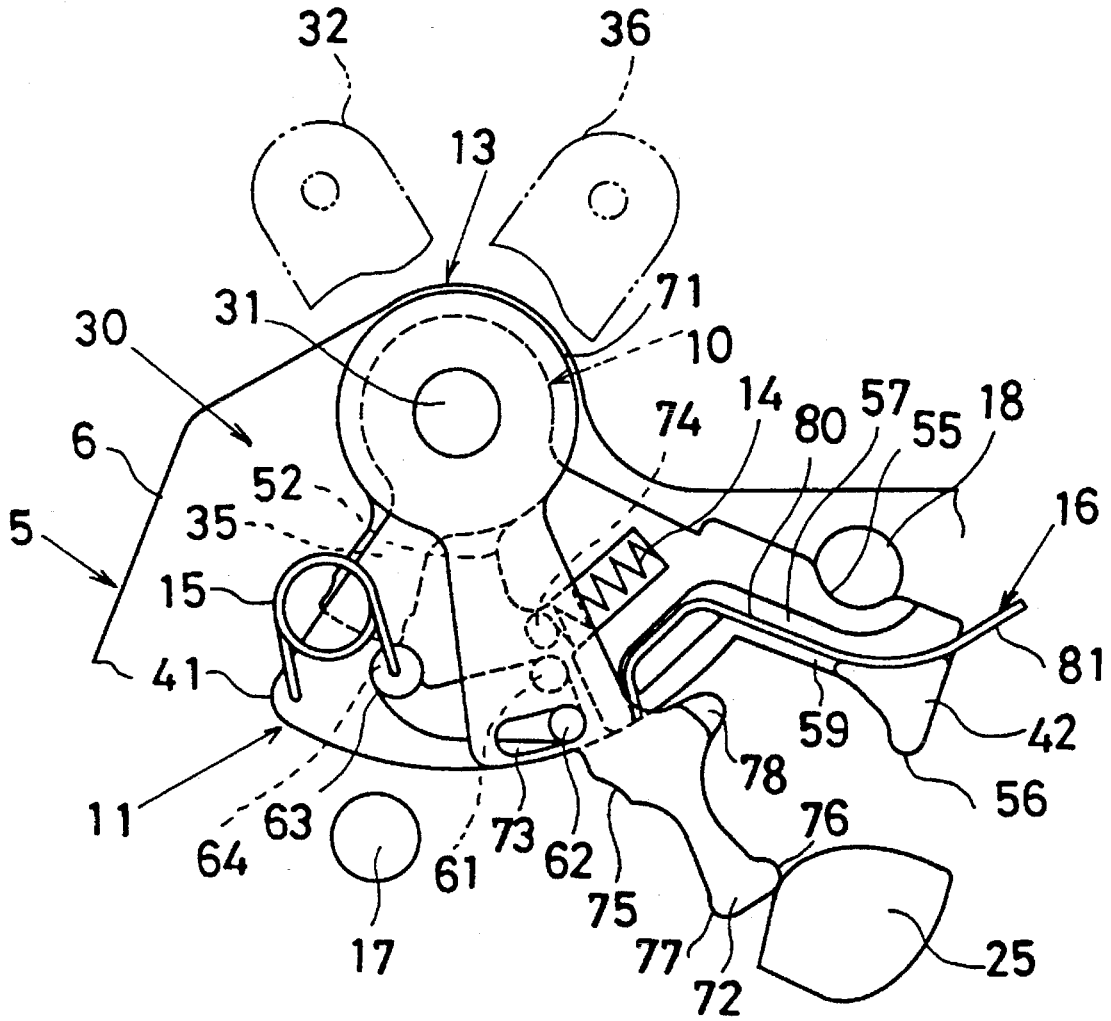
FIG. 15 is a plan view illustrating the actuator shown in FIG. 1 in the super-locking state.

On the locking-side-head of the elongation 72, a projection 76 is formed to abut the cam 25 when the clutch lever 13 turns from the super-locking position to the unlocking position as shown in FIG. 15. On the unlocking-side-head of the elongation 72, an engaging member 77 is formed to engage the cam 25 when the clutch lever turns from the locking position to the super-locking position as shown in FIG. 12. At the root portion on the locking side of the elongation 72, a projection 78 is formed. The projection 78 abuts the stopper spring 16 through the window 59 of the output lever 11 when the clutch lever 13 turns to the super-locking position (when the electric motor is energized) as shown in FIG. 12.

The return spring 14 biases the clutch lever 13 to stay in the initial position so that the turning position of the clutch lever 13 has a fixed relationship with the turning position of the output lever 11. The return spring 14 is a coil spring which biases the unlocking member 64 of the clutch arm 12 through the clutch lever 13 against the unlocking portion of the tongue 35 of the input lever 10. The return spring 14 is held on the bottom wall of the groove 49 of the output lever at one end of the spring 14 and is held by the pin 74 of the clutch lever 13 at the other end of the spring 14.

The snap spring 15 biases the clutch arm 12 in the direction that the unlocking-side member 64 engages the unlocking-side portion of the tongue 35 of the input lever 10 when the clutch lever 13 is positioned in the unlocking position or in the locking position. The snap spring 15 biases the clutch arm 12 in the direction that the unlocking-side member 64 separates from the unlocking-side portion of the tongue 35 of the input lever 10 when the torque transmitting mechanism 9 is in the super-lock state.

The stopper spring 16 is held in the groove 57 of the output lever 11. The stopper spring 16 has a bent portion 79 held in the groove 58, a buffer portion 80 to absorb shock caused when the projection of the clutch lever 13 engages the spring 16 and a buffer portion 81 to absorb the shock caused when the cam 25 engages the portion projecting from the fastening groove 60.

The unlocking stopper 17 and the locking stopper 18 are made of cushion rubber or another cushion material, and are secured to an inner periphery of the lower case of the case 6 so as to absorb shock generated when they stop the output lever 11 and the clutch lever 13. The unlocking stopper 17 limits further turn in the unlocking direction of the clutch lever 13 by catching the stop groove 75 of the elongation 72 of the clutch lever 13 when the input lever 10, the output lever 11 and the clutch lever 13 are moved from the locking position to the unlocking position. The locking stopper 18 prevents further turn in the locking direction of the input lever 10, output lever 11 and the clutch lever 13 by catching the fastening recess 55 of the elongation 42 of the output lever 11 when they are moved from the unlocking position to the locking position.

Next, the motor driving circuit 19 will be explained with reference to FIG. 1 through FIG. 3, FIG. 6, FIG. 7, FIG. 10 and FIG. 11. The motor driving circuit 19 controls electric current to the electric motor 7 according to the signal of changeover which is sent from key switch 4 and the centralized switches.

The motor driving circuit 19 is composed of a lock relay circuit 82, a lock switch 83, a plurality of connecting terminals 84*a*~84*d* and is connected to a plus terminal (+ terminal) and a minus terminal (– terminal) of a direct current source of a vehicle through a switch (not shown). The lock relay 82 is composed of a relay coil 85 and a relay switch 86 which is connected to a first motor terminal 7*a* of the motor 7 and is connected to one of two stationary contacts 86*a* and 86*b* depending on whether the relay coil 85 is energized or not. The stationary contact 86*a* is connected to the terminal 84*d*, and the stationary contact 86*b* is connected to the terminal 84*c*.

The lock switch 83 is composed of a switch spring 87 and two switch plates 88*a* and 88*b*. The switch spring 87 is a U-shaped metal-leaf spring as shown in FIG. 6. The switch spring 87 has two contact members 87*a* and 87*b* being in contact with the two switch plates 88*a* and 88*b* and two fastening holes 87*c* secured to the two projections 54 formed on the back of the output lever 11. The arm portions of the switch spring 87 (contact members 87*a*, 87*b*) are biased to contact with the two switch plates 88*a* and 88*b*.

Figure 10:
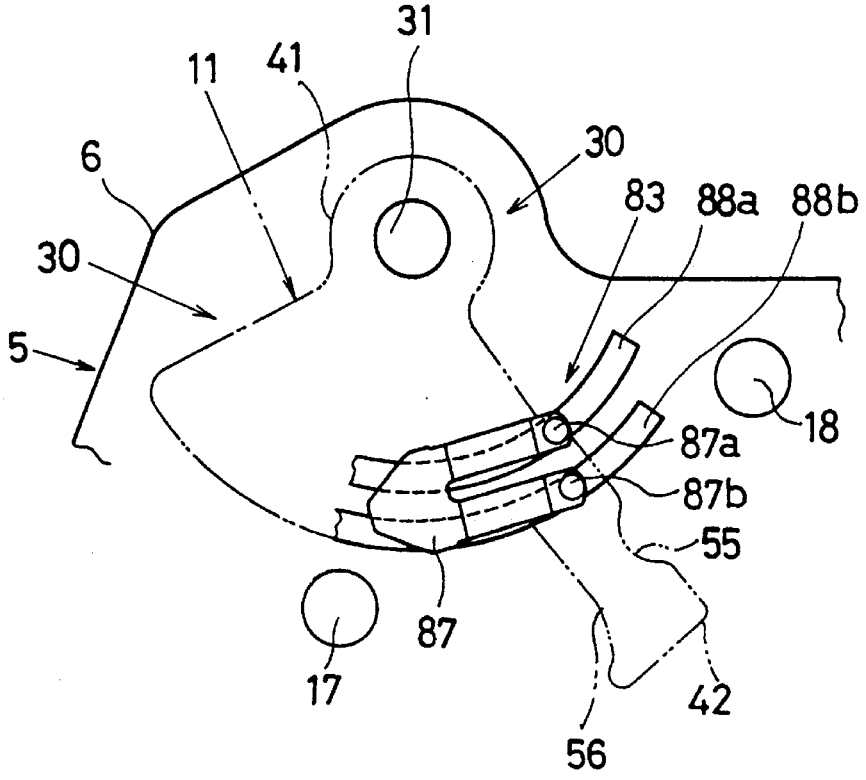
FIG. 10 is a bottom end view illustrating the actuator shown in FIG. 1 in the locking state.
Figure 11:
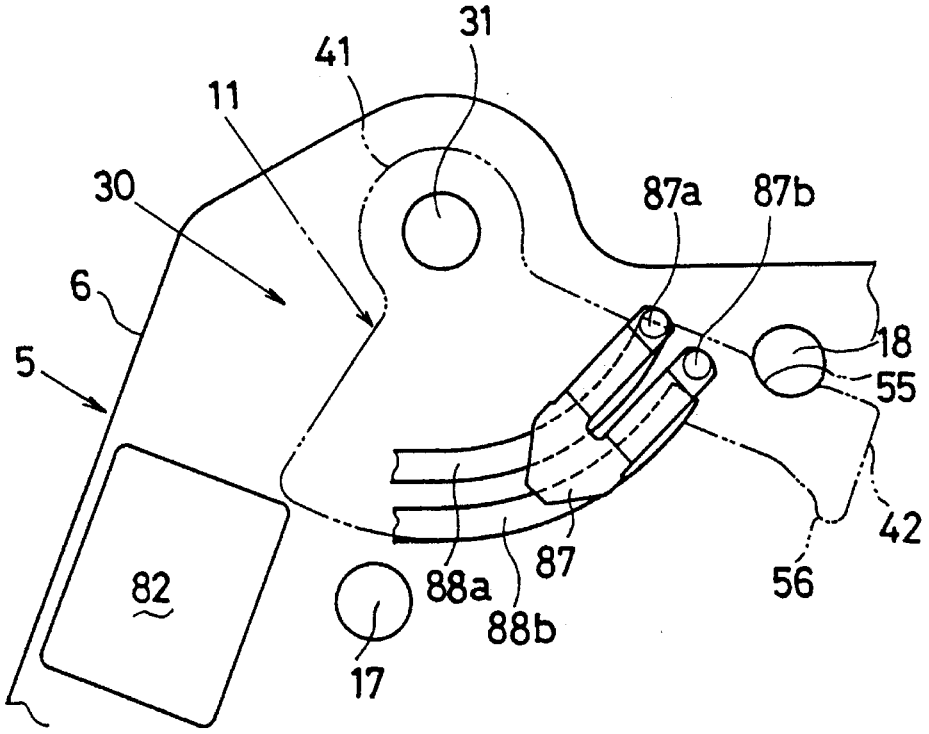
FIG. 11 is a bottom end view illustrating the actuator shown in FIG. 1 in the locking state.

The two switch plates 88*a* and 88*b* are formed into a designated pattern and secured to the inner periphery of case 6 which faces the back of the output lever 11 as shown in FIG. 10. The inner switch plate 88*a* is connected to the terminal 84*c*, and the outer switch plate 88*b* is connected to the relay coil 85. In a portion corresponding to the locking position of the output lever 11, the outer switch plate 88*b* is not disposed. That is, the outer switch plate 88*b* is located so that current supply between the switch plates 88*a* and 88*b* is interrupted when the output lever 11 comes to the locking position.

The switching circuit switches over the connections of the plus and minus terminals of the direct current source with each of the terminals 84*a* through 84*d*, as shown in FIG. 3, according to the signal (switch-over signal) corresponding to the set states (unlocking, OFF, locking, super-locking) of the key switch 4, centralized switches or the remote control door locking switch. The terminal 84*a* is connected to the second terminal 7*b* of the electric motor 7, and the terminal 84*b* is connected to the relay coil 85 of the lock relay circuit 82.

Next, an operation of the door-lock driving system for a vehicle 1 according to the first embodiment is explained briefly with reference to FIG. 1 through FIG. 15. In the drawings, FIG. 8 through FIG. 15 illustrate various operations of the clutch mechanism 30 of the actuator 5.

Ordinary Locking and Unlocking Operation

Ordinary locking and unlocking operation includes a manual operation in which the door-lock unit is driven through the clutch mechanism 30 from outside the case 6 by handling the knob 3 and a motor-driven operation in which the door-lock unit 2 is operated through the clutch mechanism 30 by the electric motor 7. At this moment, the clutch arm 12 is rotatable around the pin 61, and the unlocking member 64 is biased to engage the unlocking portion of the tongue 35 of the input lever 10 and fixes the input lever 10 in the position illustrated in FIG. 8.

In this state, the tongue 35 of the input lever 10 is sandwitched by the engaging portion 52 of the output lever 11 and the unlocking member 64 of the clutch arm 12, so that the input lever 10 is fixed to the output lever 11. Since the input lever 10 and the output lever 11 are interlocked, the rocking lever 32 and the knob lever 36 move as a unit. Since the return spring 14 biases the pin 74 of the clutch lever 13, the clutch lever 13 is also fixed to the output lever 11.

Ordinary Manual Operation of Locking and Unlocking

In the ordinary locking and unlocking manual operation, the input lever 10 and the output lever are interlocked as described before, and therefore the rocking lever 32 and the knob lever 36 move as a unit. Since the door-lock unit 2 moves to the locking position and to the unlocking position together with the knob 3, the door may be manually locked or unlocked by the knob 3.

Motor-Driven Operation from Ordinary Locking to Unlocking

The ordinary motor-driven operation from the locking state to the unlocking state is initiated by inserting a key into the key cylinder and by turning the key to energize the electric motor 7 (unlocking current supply) at the locking state of the actuator 5 as shown in FIG. 8. That is, the terminal 84*a* is connected to the plus terminal of the direct current source and the terminals 84*b* through 84*d* are connected to the minus terminal of the direct current source in the switching circuit as shown in FIG. 3 (see the first line designated by UNLOCKING in the table), and energize the electric motor 7 to turn counterclockwise in FIG. 1. In this moment, the lock switch 83 is closed.

Figure 9:
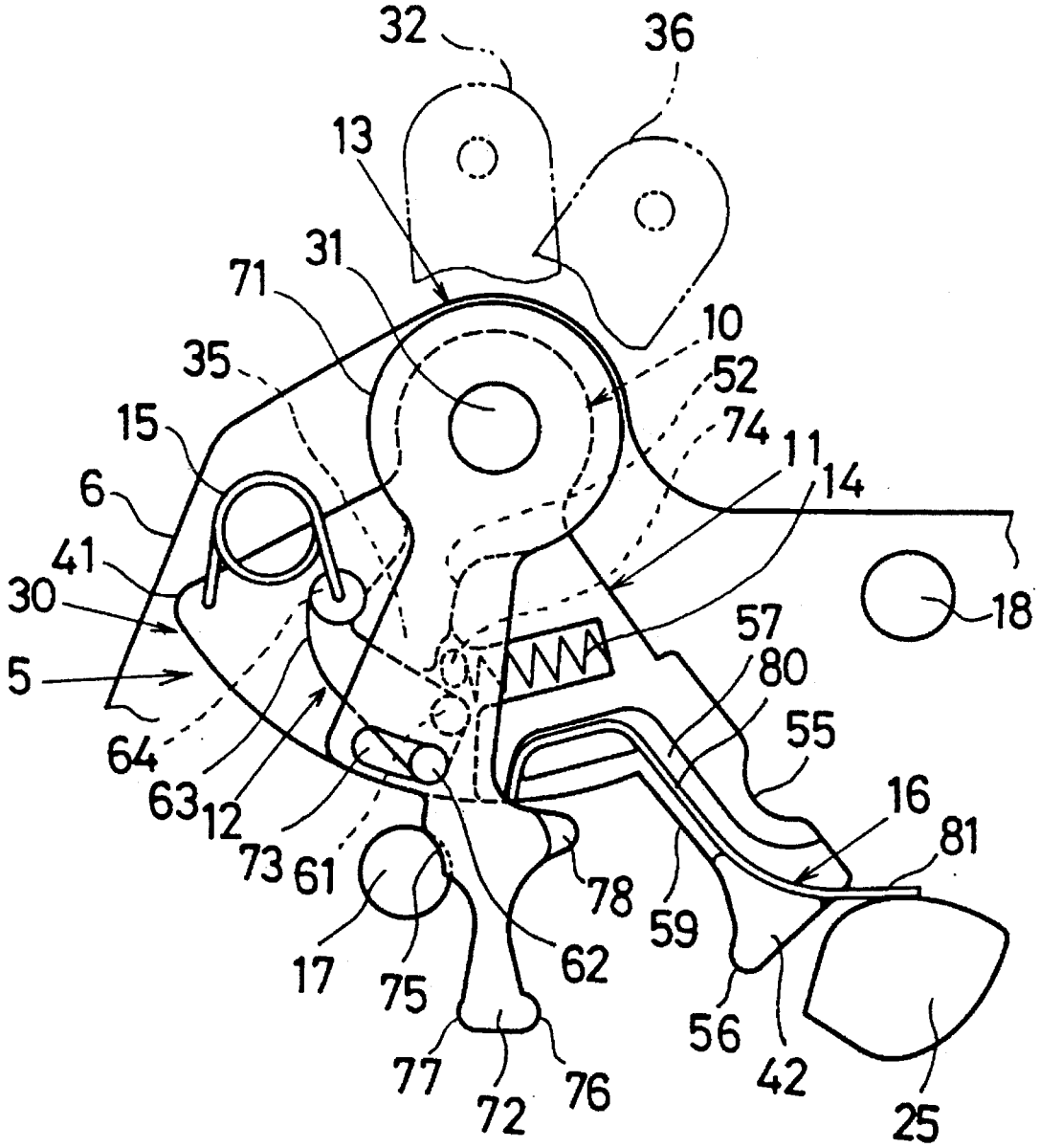
FIG. 9 is a plan view illustrating the actuator shown in FIG. 1 in the unlocking state.

When the output shaft 21 of the electric motor 7 turns, the pinion 22 and the intermediate reduction gear 23 turn counterclockwise around the rotary shaft 24 and presses on the engaging member 77 of the elongation 72 to rotate clockwise until the stop groove 75 is caught by the unlocking-side stopper 17. The cam 25 turns further until it abuts the buffer portion 81 of the stopper spring 16 and stops in the unlocking state as shown in FIG. 9.

Motor-Driven Operation from Unlocking to Ordinary Locking

The operation from the ordinary locking state (FIG. 8) to the unlocking state (FIG. 9) is initiated when a key is inserted into the key cylinder of the key switch 4 and turned to the locking position from the unlocking position and the electric motor 6 is energized (locking current supply) as shown in FIG. 3 (see the third line of the table designated by LOCKING). That is, the terminal 84*c* is connected to the plus terminal of the direct current source and the terminals 84*a*, 84*b* and 84*d* are connected to the minus terminal of the direct current source to energize the electric motor 7 so that the cam 25 turns clockwise in FIG. 1. At this time, the lock switch 83 is closed.

As described above, when the rotary shaft 21 of the electric motor 7 rotates, the pinion 22 and the intermediate reduction cam 25 rotate together, and the cam 25 rotates clockwise and presses on the projection 56 of the elongation 42 of the output lever 11. Consequently, the output lever 11 rotates around the pivot 31 counterclockwise until the engagement recess 55 of the elongation 42 is caught by the locking-side stopper 18. At this time, the lock switch 83 changes its state from the state shown in FIG. 10 to the state shown in FIG. 11 and turns off.

That is, the contact members 87*a* and 87*b* of the switch spring 87 which is fixed to the output lever 11 slide on the two switch plates 88*a* and 88*b* as the output lever 11 rotates counterclockwise, and the contact member 87*b* of the switch spring 87 separates from the switch plate 88*b*. Thus, when the lock switch 83 is turned off, the relay coil 85 of the lock relay circuit 82 is deenergized and the relay switch 86 changes the connection from the stationary contact 86*b* to the stationary contact 86*a*. As a result, as shown in FIG. 3, since both the first and the second motor terminals 7*a* and 7*b* are connected to the minus terminal of the direct current source, the electric motor 7 stops. Subsequently, since the cam 25 stops the clockwise rotation and comes to the locking state as shown in FIG. 8, the cam 25 is prevented from erroneously driving the clutch lever 13 to render the actuator 5 in the super-locking state.

Operation into Super-Locking

The operation to the super-locking state is initiated when a key is inserted into the key cylinder of the key 4 and turned to the super-lock position from the locking position. The electric motor 7 is energized (super-lock current supply) as shown in FIG. 3 (see the fourth line of the table designated by SUPER-LOCKING). That is, the terminal 84*d* is connected to the plus terminal of the direct current source, and the terminal 84*a* through 84*c* are connected to the minus terminal of the direct current source to energize the electric motor 7 to rotate the cam 25 clockwise.

As a result, the cam turns clockwise regardless of the lock switch 83 being closed or opened, and presses on the engaging member 77 of the elongation 72 of the clutch lever 13. Consequently, the clutch lever 13 rotates counterclockwise further. Since the output lever 11 is caught by the locking-side stopper 18, only the clutch lever 13 rotates around the pivot 31 counterclockwise while compressing the return spring 14 at the pin 74.

When the clutch lever 13 rotates relative to the output lever 11 further than the marginal rotation angle θ° defined by the groove 73 (FIG. 8), the pin 62 of the clutch arm 12 is biased at the unlocking end of the elliptic opening 73 to rotate counterclockwise around the pin 61, causing the snap spring 15 to snap forth. Subsequently, the super-locking state (when the electric motor 7 is energized) is established, as shown in FIG. 12, where the projection 78 of the elongation 72 of the clutch lever 13 abuts the buffer portion 80 of the stopper spring 16 through the window 59 of the output lever 11 and counterclockwise turn of the clutch lever 13 stops. The door-lock unit 2 remains at the locking position and the door locking state continues so long as the rocking lever 32 is not operated.

Figure 13:
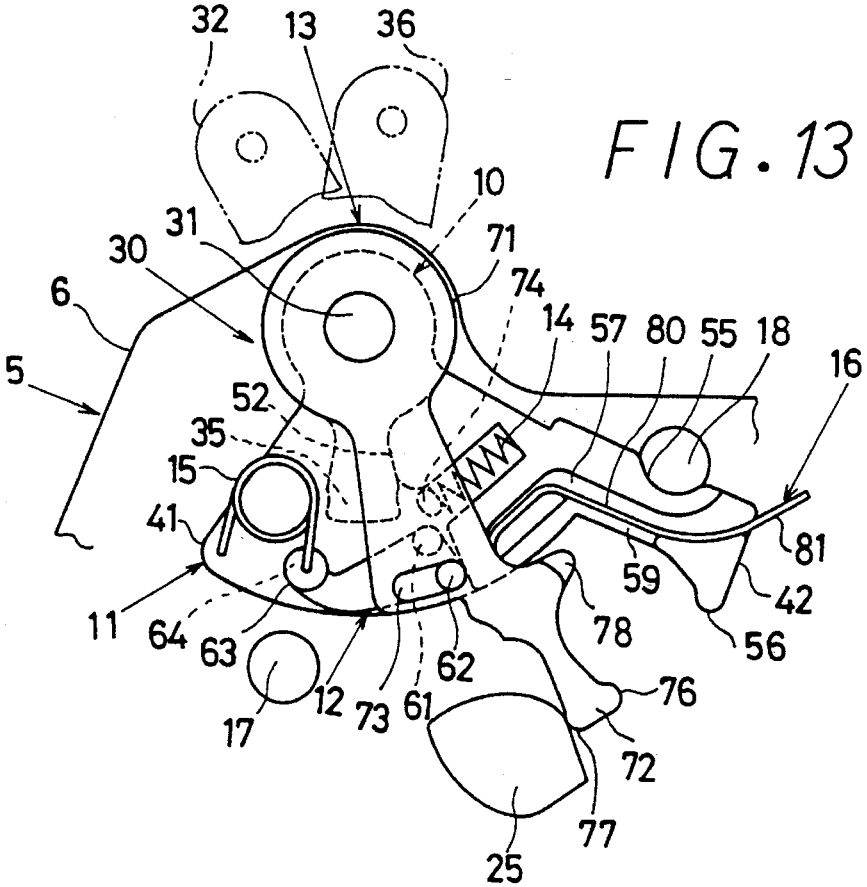
FIG. 13 is a plan view illustrating the actuator shown in FIG. 1 in the super-locking state.

Thereafter, when the electric motor 7 is deenergized and the torque to rotate the cam 25 clockwise disappears, the clutch lever 13 is brought back due to the repulsion force (resilient force) of the return spring 14 and the clutch lever 13 turns around the pivot 31 and stops in the super-locking state (when the electric motor 7 is deenergized) as shown in FIG. 13. By the way, the load applied to the snap spring 15 and the shape of the elliptic opening 73 of the clutch lever 13 are arranged so that the clutch arm 12 may not return to the locking position by chance.

Operation of Knob 3 during Super-Locking

Figure 14:
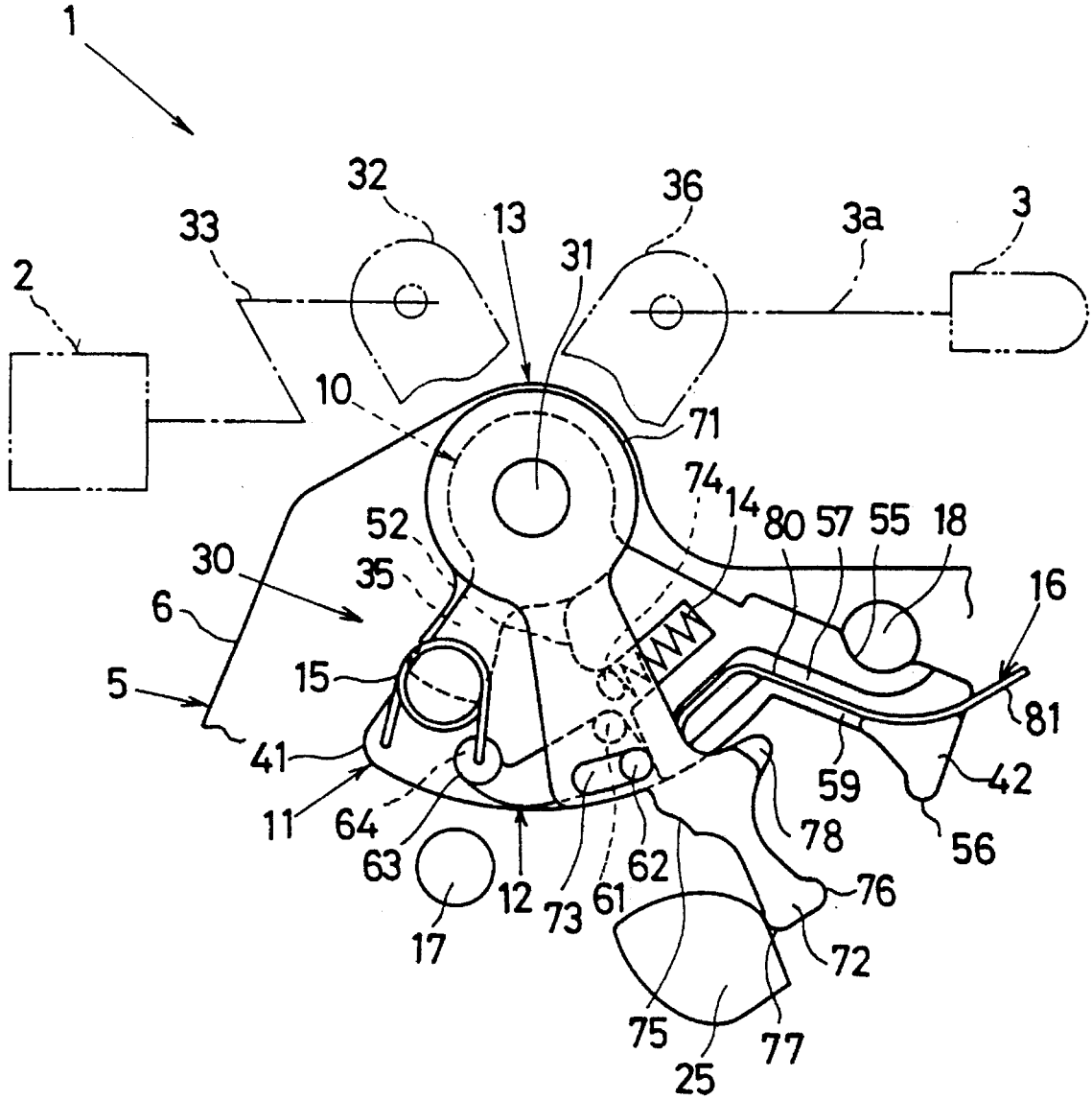
FIG. 14 is a plan view illustrating the actuator shown in FIG. 1 in the super-locking state.

In the super-locking state shown in FIG. 13, even if the knob 3 is moved to the unlocking position as shown in FIG. 14, the output lever 11 is not operated and the door-lock unit 2 remains in the door-locking state since the unlocking-side portion of the tongue 35 of the input lever 10 does not engage the unlocking-side portion 64 of the clutch arm 12.

As a result, during the super-locking state, even if the knob 3 is moved to the unlocking position, the output lever 11 is not operated, and therefore the door-lock unit 2 is not driven to the unlocking position. Of course, if the knob 3 is moved to the unlocking position during the super-locking state, any excessive force is not applied to the door-lock unit 2, the electric motor 7 and the torque transmitting mechanism 9, and consequently they are free from damage.

Release from Super-Locking

The super-locking state is released when a key is inserted into the key cylinder of the key switch 4 during the super-locking state shown in FIG. 13 and turned to the unlocking position to energize (unlocking-current supply) the electric motor 7 in the same manner as when the motor is driven to change from the locking position to the unlocking position shown in FIG. 3.

When the electric motor 7 rotates, the cam 25 turns counterclockwise around the rotary shaft 24 and presses on the projection 76 of the elongation 72 of the clutch lever 13 to rotate around the pivot 31 clockwise until the engagement groove 75 of the elongation 72 abuts the unlocking-side stopper 17. At this time, the clutch arm 12 causes the snap spring 15 to snap back as the pin 62 is biased by the locking-side portion of the elliptic opening 73, and turns clockwise around the pin 61. Thereafter, the cam 25 further turns until it abuts the buffer portion 81 of the spring 16 and stops in the unlocking position, where the super-locking state is released.

As shown in FIG. 14, when the super-locking state is being released, the clutch arm 12 turns clockwise around the pin 61 under the spring force of the snap spring 15 while the unlocking-side member 64 of the clutch arm 12 presses on the peripheral surface of the input lever 10 from the locking-side portion to the unlocking-side portion and remains in engagement with the unlocking-side portion of the tongue 35, and, thus, the clutch arm may not be brought back to the super-locking state. Since the input lever 10 and the output lever 11 are interlocked to move as a unit, the ordinary unlocking and locking operations is carried out again.

Motor-driven Operation from Unlocking to Ordinary Locking When Knob 3 is Placed in Unlocking Position When the actuator 5 is placed in the unlocking state as shown in FIG. 9 and the knob 3 and the input lever 10 are placed in the unlocking position, if the motor is supplied with the locking current (or energized to rotate clockwise in FIG. 1) by a key, since the input lever 10, the output lever 11 and the clutch lever 13 are interlocked as shown in FIG. 9 (the output lever 12 and the clutch lever 13 cannot move independently and the torque is not transmitted to the elongation 72 of the clutch lever 13 from the cam 25), the unlocking-side portion 64 of the clutch arm 12 would not disengages from the unlocking-side portion of the tongue 35 of the input lever 10. As a result, the actuator 5 cannot shift to the super-locking state further after it has been shifted to the ordinary locking state.

When the actuator 5 is in the unlocking state, even if the electric motor 7 is energized to shift the actuator 5 to the locking state while the knob 3, the input lever 10 and the knob lever 36, etc. are fixed, the tongue 35 of the input lever 10 is sandwitched by the locking-side portion 52 of the output lever 11 and the unlocking-side portion 64 of the clutch arm 12 and cannot move. Consequently, the actuator 5 is prevented from erroneously driving the clutch mechanism 30 into the super-locking state when the actuator 5 is operated to shift to the locking state while fixing the knob 3 and the input lever 10. As a result, there is no possibility of the manually operated knob 3 being unable to change over the door-lock unit 2 from the locking state to the unlocking state.

Figure 16:
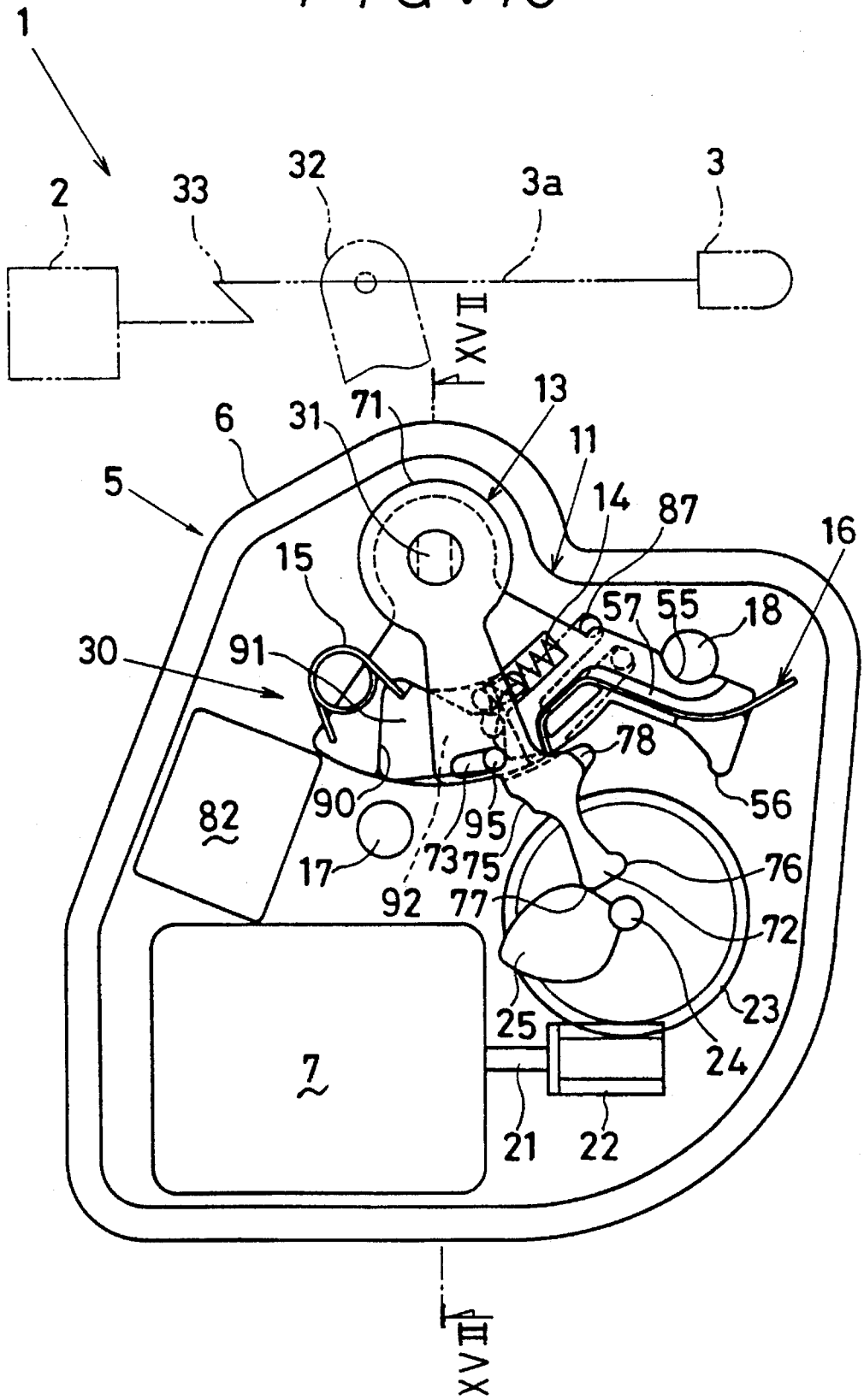
FIG. 16 is a plan view illustrating an actuator of a door-lock driving unit according to a second embodiment of the invention.
Figure 17:
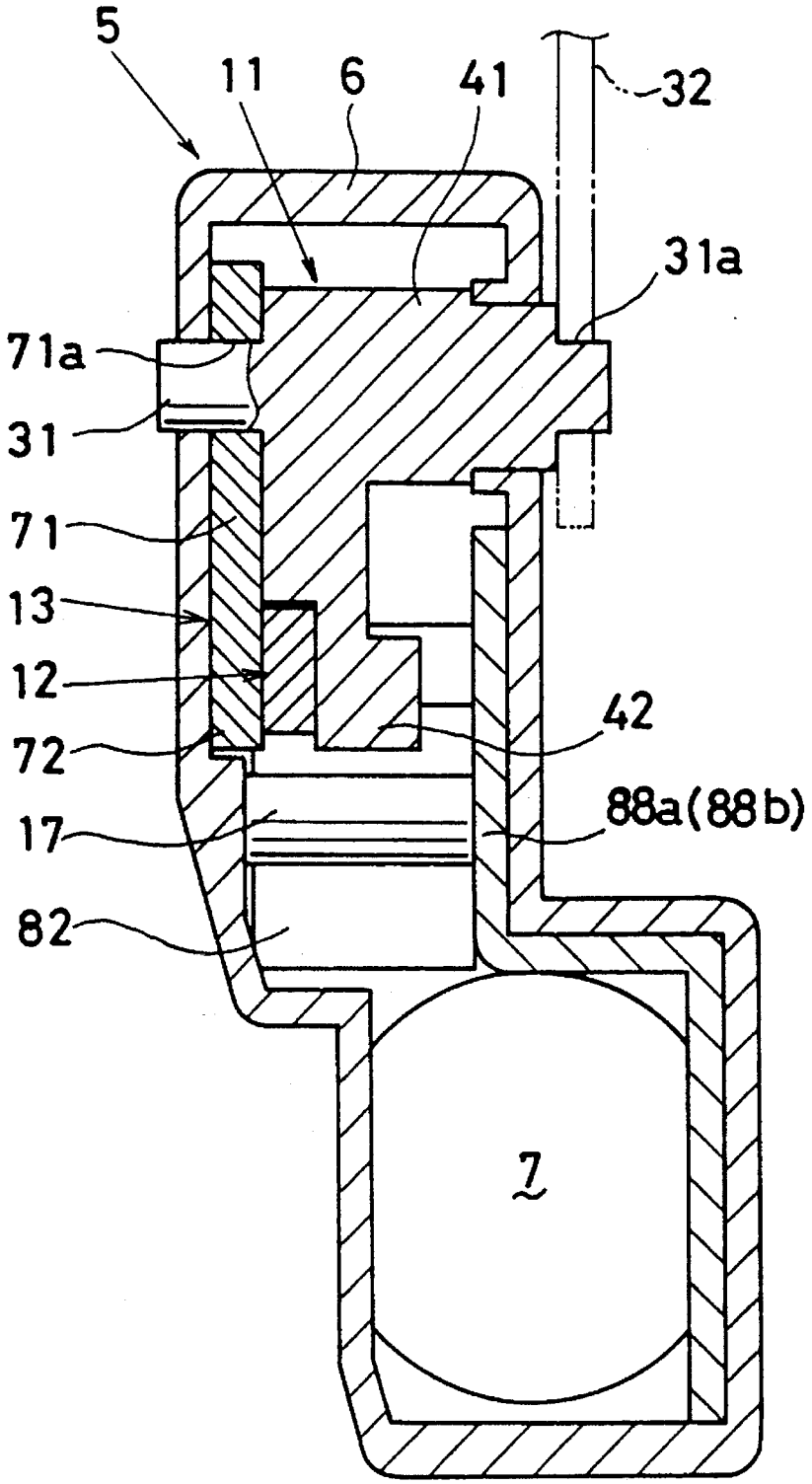
FIG. 17 is a cross-sectional view taken along line XVII—XVII of FIG. 16.
Figure 18:
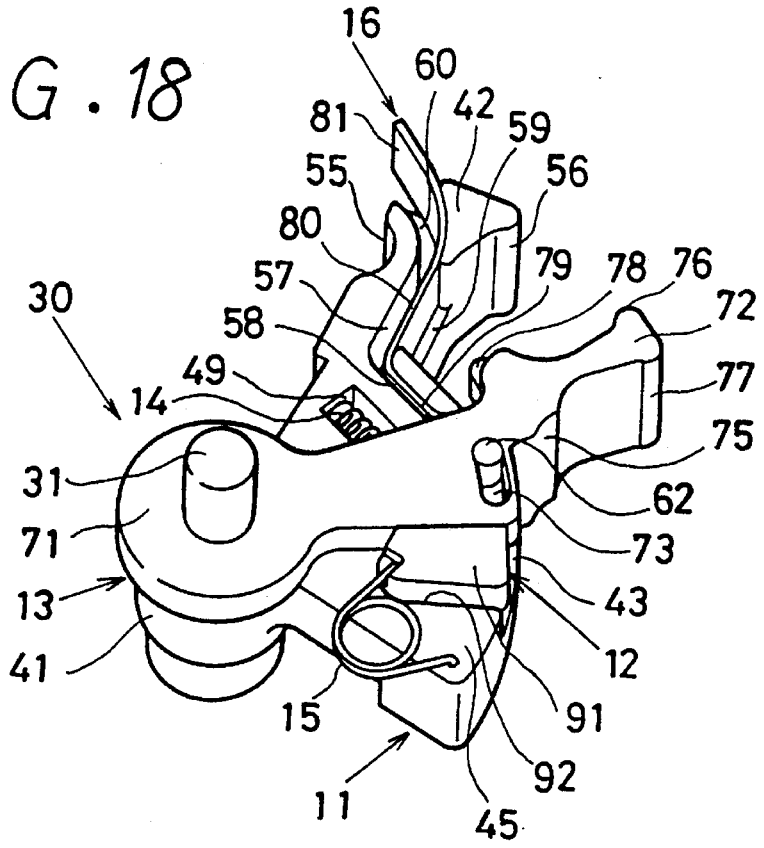
FIG. 18 is a perspective view illustrating the clutch mechanism shown in FIG. 16.
Figure 19:
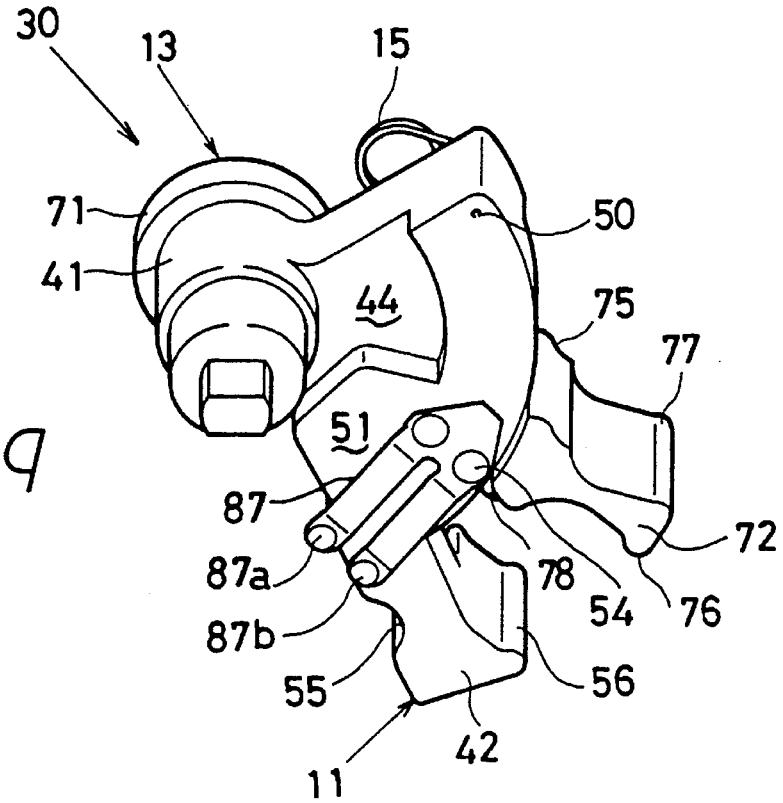
FIG. 19 is a perspective view illustrating the clutch mechanism shown in FIG. 16.

FIG. 16 through FIG. 23 illustrate a second embodiment of the present invention, and FIG. 16 and FIG. 17 illustrate an actuator of the door-lock driving system for a vehicle, and FIG. 18 and FIG. 19 illustrate a clutch mechanism of the actuator. The same reference numerals correspond to the same or similar portions or components and, therefore, detailed descriptions thereof are not made in the embodiments to follow hereafter.

An actuator 5 according to the second embodiment has a pivot 31 and a rocking lever 32 carried on the pivot 31, and the rocking lever 32 is connected to the joint 33 which is connected to the door-lock unit 2 and the rod **3*a* which is connected to the knob 3 of a door. Therefore, the input lever 10 and the knob lever 36 of the first embodiment are omitted in this embodiment, and, therefore, the number of parts is reduced and the back surface of the output lever 11 (locking-side portion 52 of the output lever 11 in the first embodiment is omitted) and the shape of a clutch arm 12 are simplified. Further, a clutch arm 12, which is rotated by a clutch lever 13, is molded integrally with a resinous material and formed into approximately a trapezoid which has an engaging portion 91 and a flat portion 92. The flat portion 92 is thinner by the thickness of the clutch lever 13 than the thickness of the engaging portion 91**.

Figure 20:
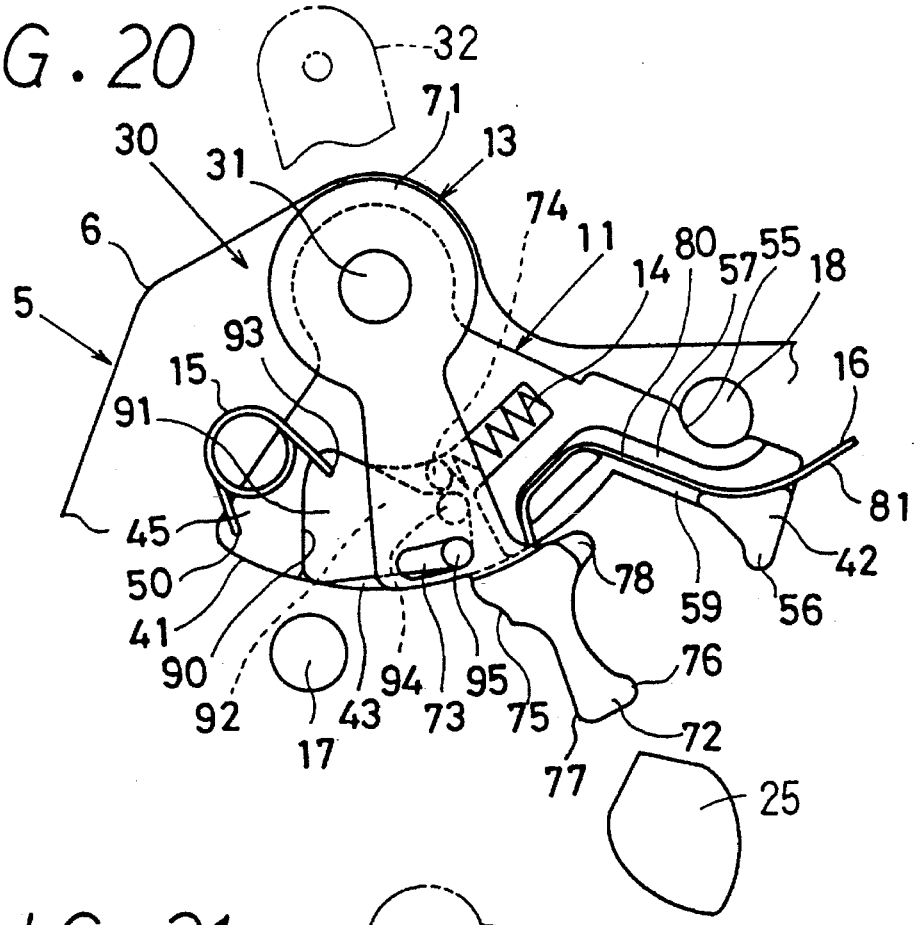
FIG. 20 is a plan view illustrating the actuator shown in FIG. 16 in the locking state.
Figure 21:
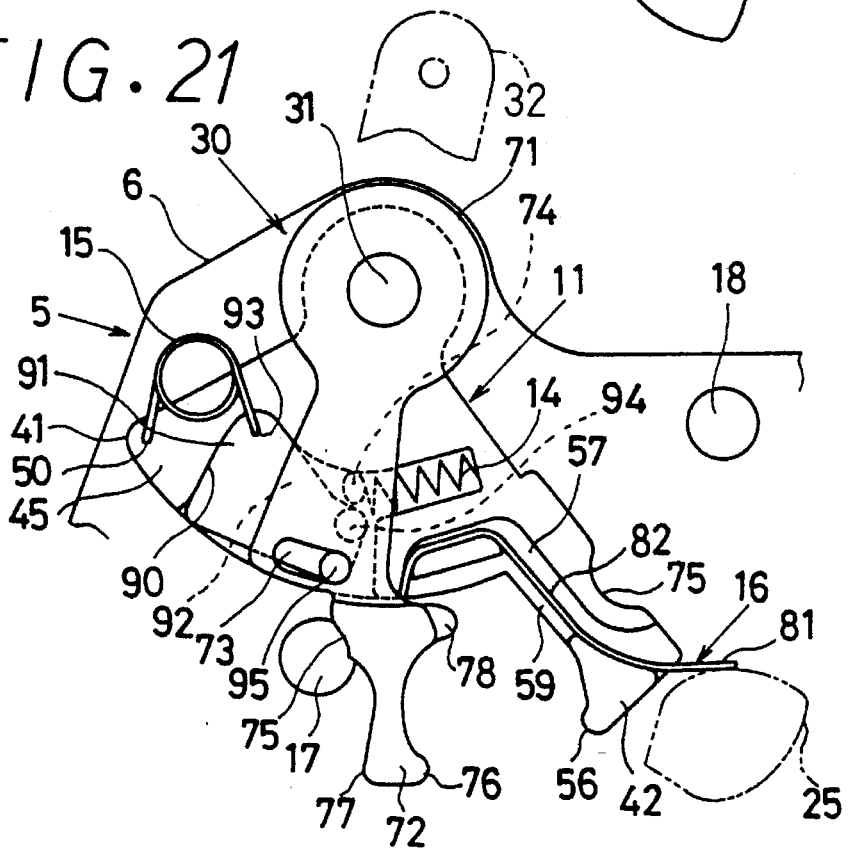
FIG. 21 is a plan view illustrating the actuator shown in FIG. 16 in the unlocking state.

The engaging portion 91 engages an engaging wall 90 which is formed at the unlocking-side of a bulged portion 45 of the output lever 11 and the unlocking-side portion of a base portion 71 of the clutch lever 13 when the actuator 5 is in the unlocking state and in the ordinary locking state. At the surface of the engaging portion 91, a receiving hole 93 is formed to retain the other side of the snap spring 15 as shown in FIG. 20. At the back of the flat portion 92, a cylindrical pin 94 is secured and pivotally supported by a receiving hole 46 of the output lever 11. A cylindrical pin 95 is secured at the front of the flat portion 92 to engage the elliptic opening 73 of the clutch lever 13.

Next, the operation of the door-lock driving unit for a vehicle according to the present embodiment is described briefly with reference to FIG. 16 through FIG. 23. FIG. 20 through FIG. 23 illustrate various states of the operation of the clutch mechanism 30 of the actuator 5. The shifting between the unlocking state (FIG. 21) and the ordinary locking state (FIG. 20) is the same that of the first embodiment, and therefore is omitted. If the actuator 5 is driven by the motor and shifts from the unlocking state to the locking state while the knob 3 and the knob lever 36 are fixed, any component of the actuator 5 does not move relative to other components, and the shifting to the super-locking state may not take place.

The super-locking in this embodiment is carried from the locking state shown in FIG. 20 by supplying the super-locking current to the electric motor 7 so that the cam 25 rotates clockwise to press on an elongation 72 of the clutch lever 13 to rotate counterclockwise. When the clutch lever 13 rotates counterclockwise further than the marginal angular gap θ° relative to the output lever 11 (cf. FIG. 8 for the first embodiment), the pin 95 of the clutch arm 12 is pressed on by the unlocking portion of the elliptic opening 73, so that the clutch arm 12 turns counterclockwise around the pin 61 to cause snapping or jumping of the snap spring 15. As a result, the clutch arm 12 leaves the portion between the engaging wall 90 of the output lever 11 and a base portion 71 of the clutch lever 13, and settles on the same circumference around the pivot 31 as a unlocking-side stopper 17 due to the spring force of the snap spring 15.

Figure 22:
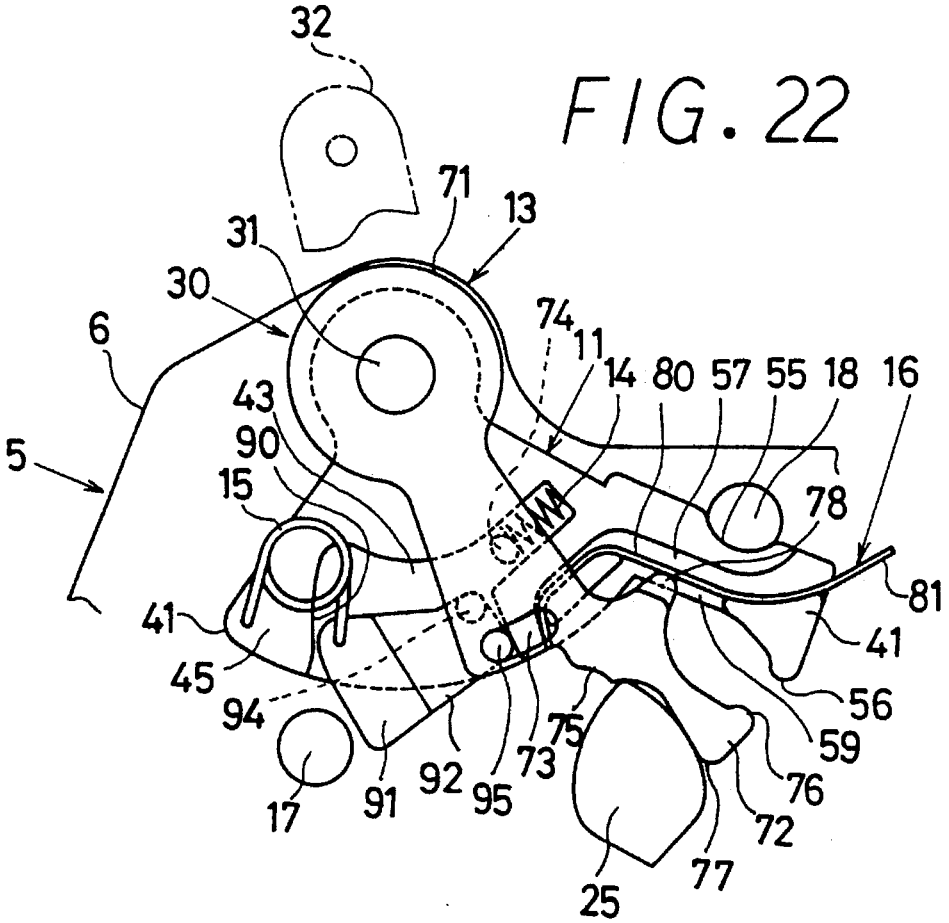
FIG. 22 is a plan view illustrating the actuator shown in FIG. 16 in the super-locking state.

Subsequently, the super-locking state (when the electric motor 7 is energized) as shown in FIG. 22 is carried out, and a projection 78 of the elongation 72 of the clutch lever 13 abuts a buffer portion 80 of the stopper spring 16, thereby stopping the counterclockwise rotation of the clutch lever 13. At this time, the door-lock unit 2 remains in the locking position, and neither the output lever 11 nor the rocking lever 32 move further.

Figure 23:
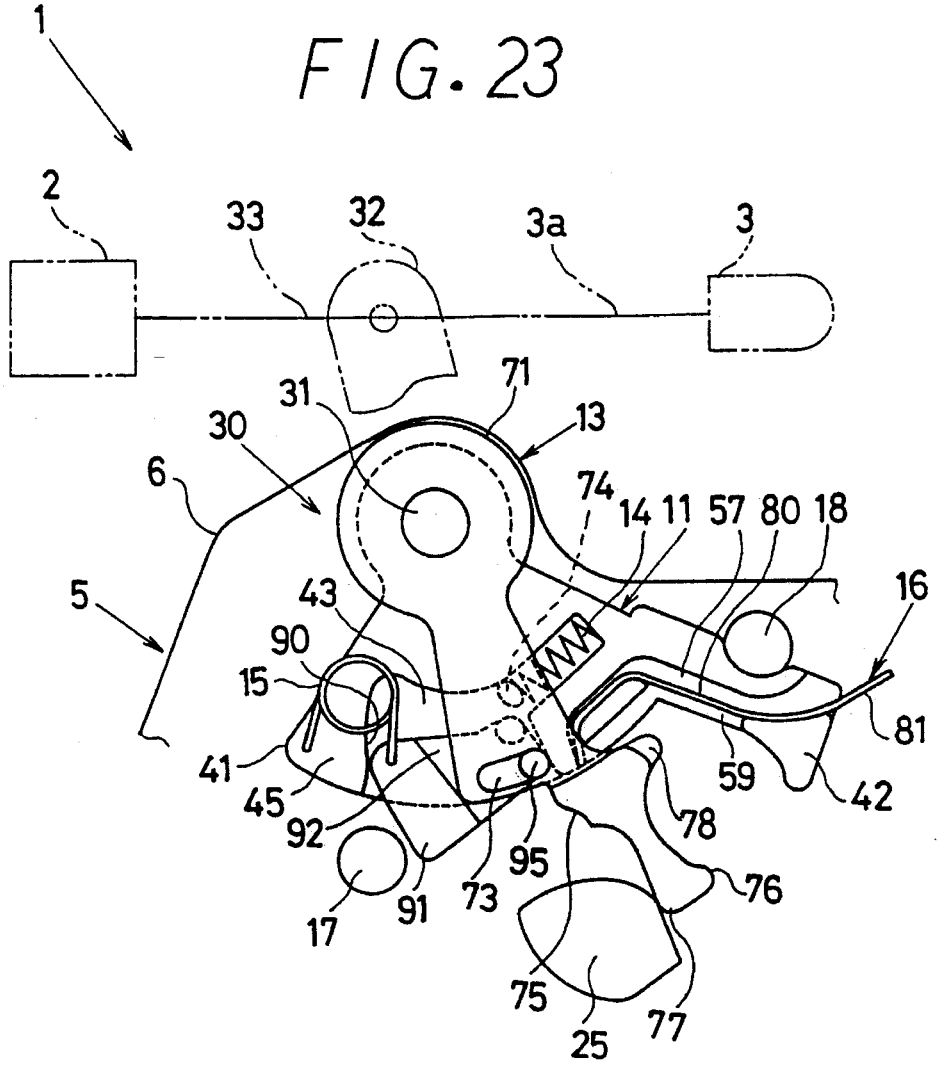
FIG. 23 is a plan view illustrating the actuator shown in FIG. 16 in the super-locking state.

Thereafter, when the electric motor 7 is deenergized, the clutch lever 13 is brought back due to the repulsion force (resilient force) of a return spring 14 and stops in the super-locking state (when the electric motor is deenergized) as shown in FIG. 23. If the knob 3 is moved to the unlocking position during the super-locking state shown in FIG. 23, the knob 3 does not move as the clutch arm 12 is locked by the unlocking-side stopper 17. Thus the changeover to the unlocking position is not possible.

Figure 24:
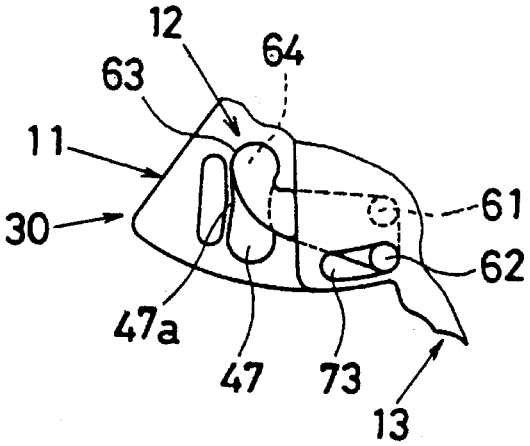
FIG. 24 is a plan view illustrating a main portion of a clutch mechanism of an actuator used in a door-lock driving unit according to a third embodiment of the invention.

FIG. 24 illustrates a main portion of a clutch mechanism of a door-lock driving system for a vehicle according to a third embodiment of the present invention. In this embodiment, a resilient wall **47*a* is formed as a snap member in an elliptic opening 47 which functions substantially in the manner as the preceding snap spring. Thereby, the snap spring 15** of the preceding embodiments is omitted and the number of parts is reduced.

Figure 25:
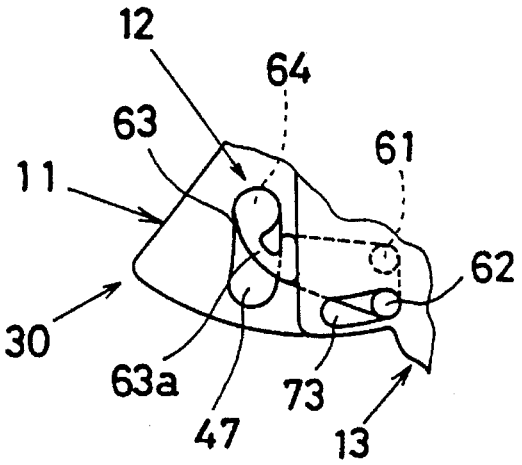
FIG. 25 is a plan view illustrating a main portion of a clutch mechanism of an actuator used in a door-lock driving unit according to a fourth embodiment of the invention.

FIG. 25 illustrates a main portion of an actuator clutch mechanism of a door-lock driving system for a vehicle according to a fourth embodiment of the present invention. In this embodiment, a resilient neck **63*a* is formed as a snap member on a rocking potion in engagement with an elliptic opening 47 of the output lever 11. The resilient neck functions substantially in the same manner as the snap spring of the preceding embodiments. Thereby, the snap spring 15** of the preceding embodiment is omitted and the number of parts is reduced.

Figure 26:
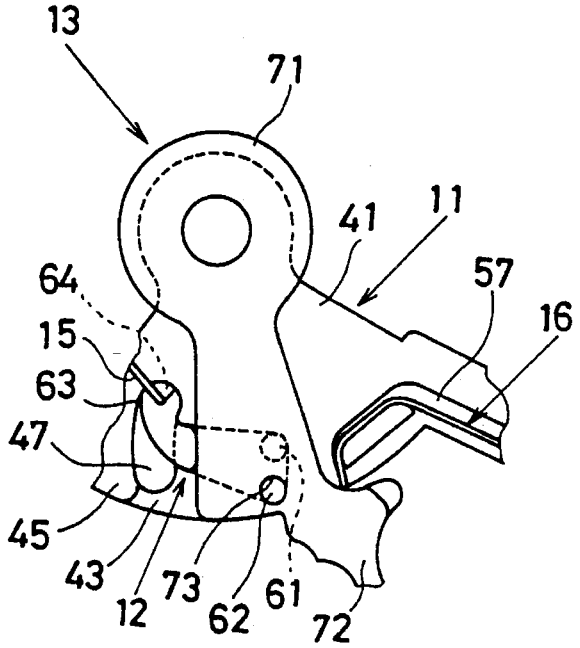
FIG. 26 is a plan view illustrating a main portion of a clutch mechanism of an actuator used in a door-lock driving unit according to a fifth embodiment of the invention.

FIG. 26 illustrates a main portion of an actuator clutch mechanism of a door-lock driving system for a vehicle according to a fifth embodiment of the present invention. In this embodiment, the return spring 14 is omitted by reducing the marginal angular gap for the pin 62 of the clutch arm 12 in engagement with the elliptic opening 73 of the clutch lever 13 of the preceding embodiments to almost zero, thereby reducing the number of parts.

Figure 27:
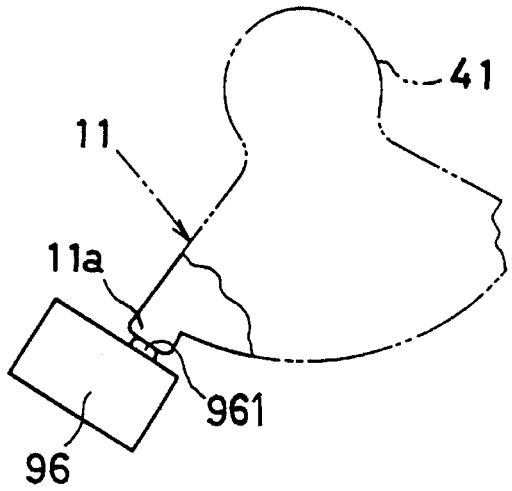
FIG. 27 is a bottom end view illustrating an actuator of a door-lock driving unit in the locking state according to a sixth embodiment of the invention.
Figure 28:
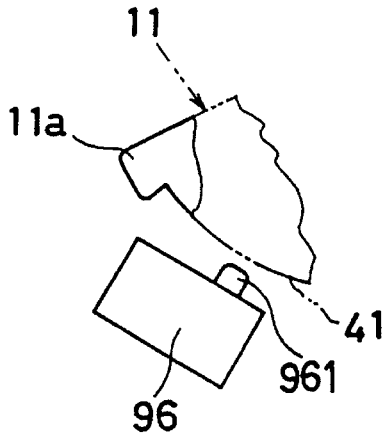
FIG. 28 is a bottom end view illustrating an actuator of a door-lock driving unit in the unlocking state shown in FIG. 27.
Figure 29A:
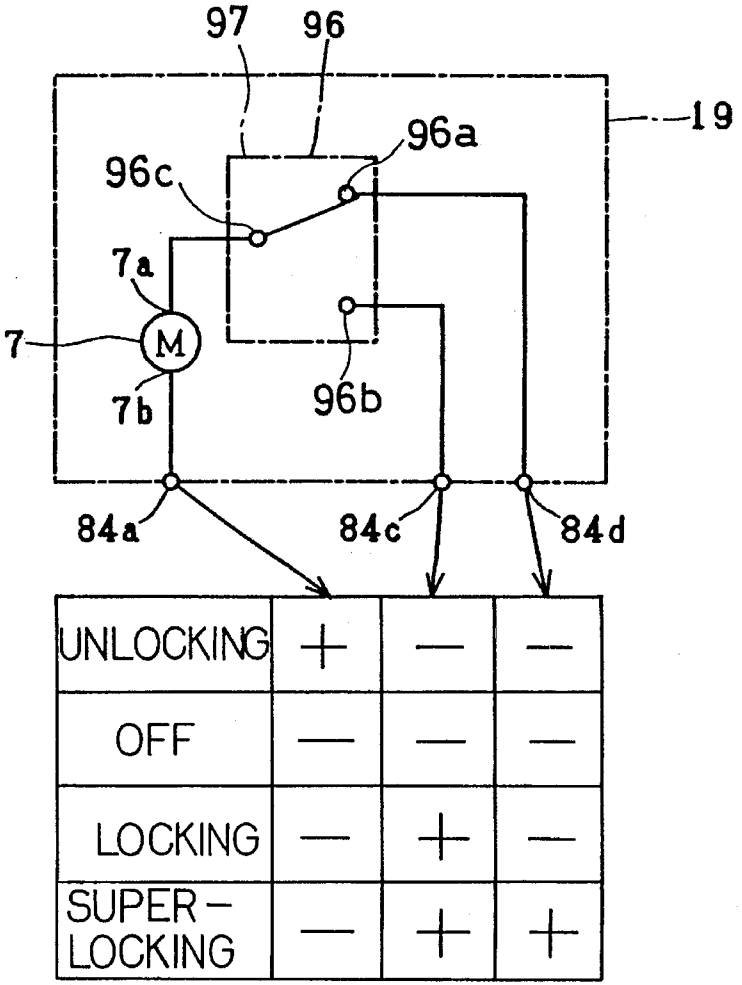
FIG. 29A is an electric circuit diagram illustrating a motor energizing circuit of the actuator shown in FIG. 27.
Figure 29B:
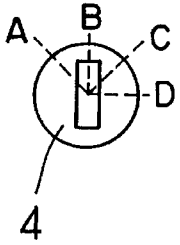
FIG. 29B is a front view illustrating a key switch.

FIG. 27 through FIG. 29 illustrate specific portions of a sixth embodiment of the invention, and other portions are substantially the same as the preceding embodiments. FIG. 27 and FIG. 28 illustrate a lock switch of a motor driving circuit of an door-lock driving system for a vehicle, and FIG. 29 illustrates a key switch and a motor driving circuit of the door-lock driving system. In this embodiment, the lock switch 97 is composed of a projection 11*a* formed on the locking-side of the output lever 11 and a micro-switch 96 having a push button 961 which is engageable with the projection 11*a*. By the way, another position sensor having a contact such as a limit switch or a touch switch or a contactless position sensor such as an approach sensor or a opto-electronic switch may be replaced by the micro switch 96.

The motor driving circuit 19 of this embodiment is composed of a micro-switch 96, connecting terminals 84*a*, 84*c*, and 84*d* and is connected to a plus terminal and a minus terminal of a direct current source through a switching circuit. The micro switch 96 is connected to a first motor terminal 7*a* of the electric motor 7 and is connected to either one of stationary contacts 96*a* or 96*b* depending on the push button 961 being in engagement or disengagement with the projection 11*a*. The stationary contact 96*a* is connected to the terminal 84*d*, and the stationary contact 96*b* is connected to the terminal 84*c*. The terminal 84*a* is connected to the second motor terminal 7*b* of the motor 7.

With the above structure, when the key is inserted into the key switch 4 and is turned from the unlocking position to the locking position when the door is in the locking state where the output lever 11 is in abutment with the locking-side stopper (18 of the preceding embodiments), the projection 11*a* formed at the locking-side of the output lever 11 pushes the push button 961 of the micro switch 96. Consequently, the micro switch 96 connects the stationary switches 96*b* and 96*c*, the electric motor 7 is deenergized and the output lever 11 stops rotation.

When the key in the key switch 4 is further turned from the locking position to the super-locking position, the electric motor 7 is energized again so that the shifting from the locking state to the super-locking state is carried out. As a result, the lock relay circuit 82, the switch spring 87 and two switch plates 88*a* and 88*b* of the preceding embodiments are omitted and the number of parts are reduced.

Figure 30:
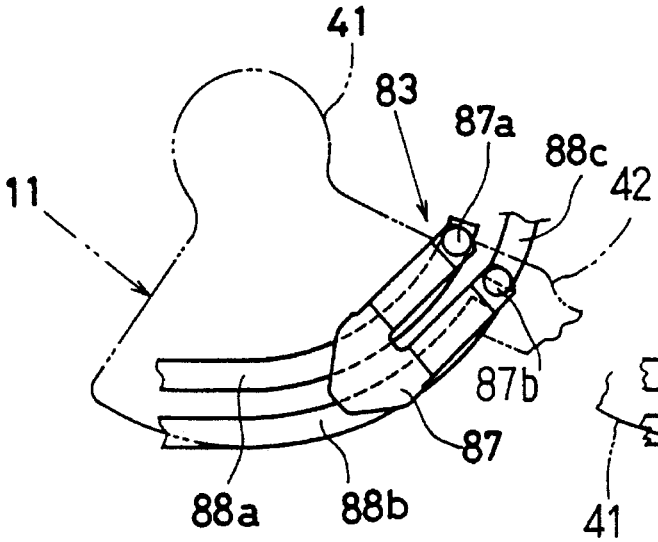
FIG. 30 is a bottom end view illustrating an actuator of a door-lock driving unit in the locking state according to a seventh embodiment of the invention.
Figure 31:
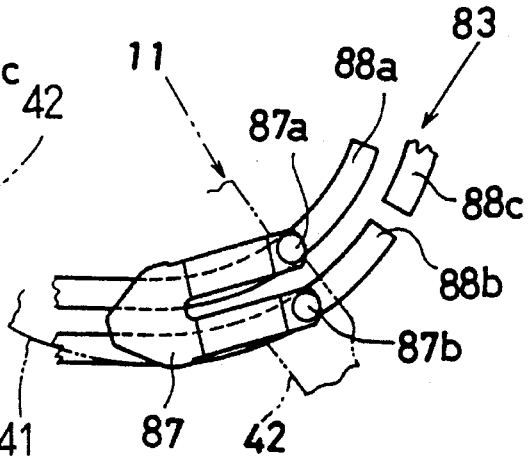
FIG. 31 is a bottom view illustrating an actuator of a door-lock driving unit in the unlocking state shown in FIG. 30.

FIG. 30 and FIG. 31 illustrate a lock switch used in the driving circuit of a door-lock driving system according to a seventh embodiment of the present invention. In this embodiment, the switch pattern of the two switch plates 88*a* and 88*b* of the lock switch 83 is arranged to switch on, off and on as the output lever rotates from the unlocking position to the locking position. and the lock relay 82 of the preceding embodiments is omitted.

Figure 32A:
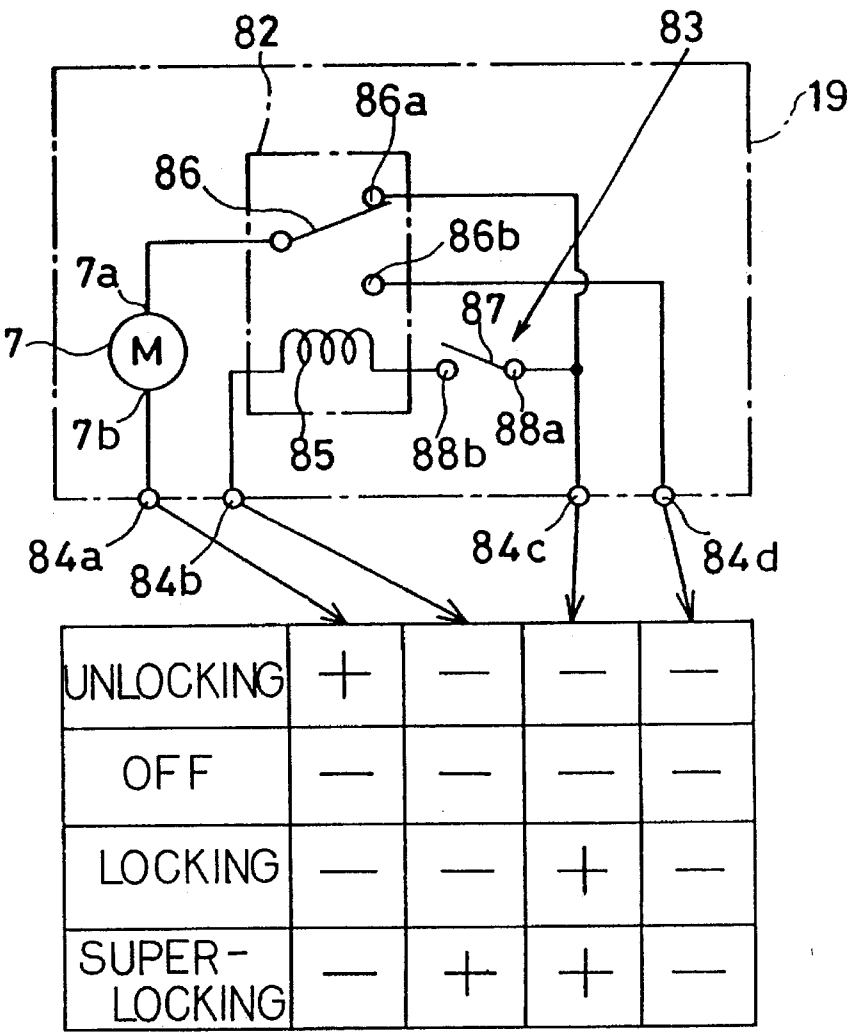
FIG. 32A is an electric circuit diagram illustrating a motor energizing circuit of the actuator used in a door-lock driving system according to an eighth embodiment of the present invention.
Figure 32B:
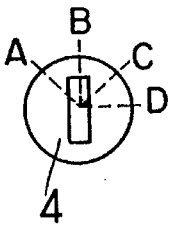
FIG.32B is a front view illustrating a key switch.

FIG. 32 illustrates a key switch and a motor driving circuit of a door-lock driving system according to a eighth embodiment of the present invention. In the motor driving circuit 19 of this embodiment, a stationary contact 86*a* of the lock relay circuit 82 is connected to the connecting terminal 84*c*, and the stationary contact 86*b* is connected to the connecting terminal 84*d*. When the super-locking is being carried out, the connecting terminals 84*b* and 84*c* are connected to a plus terminal of a direct current source and the connecting terminals 84*a* and 84*d* are connected to a minus terminal of the direct current source (see the fourth line of the table of FIG. 32 designated as SUPER-LOCKING) so that the cam 25 rotates clockwise to energize the electric motor 7.

Figure 33A:
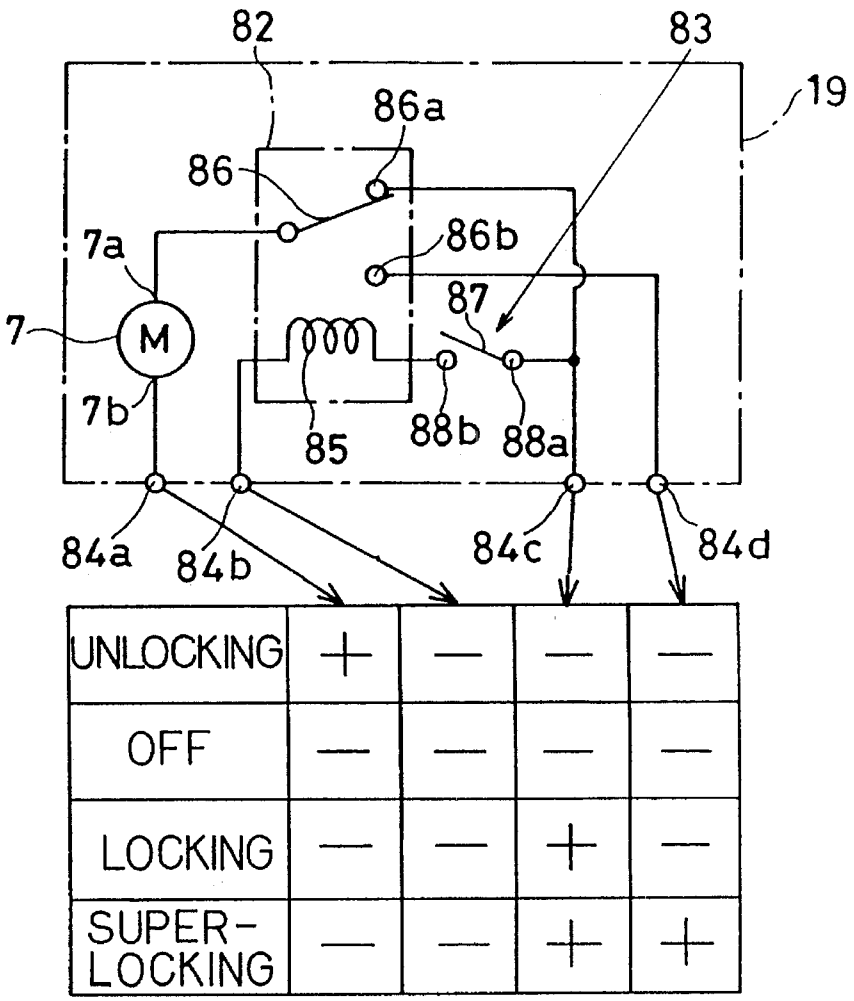
FIG. 33A is an electric circuit diagram illustrating a motor energizing circuit of the actuator used in a door-lock driving system according to ninth embodiment of the present invention.
Figure 33B:
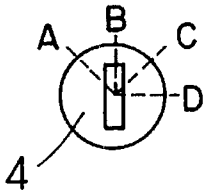
FIG. 33B is a front view illustrating a key switch.

FIG. 33 illustrates a key switch and a motor driving circuit of a door-lock driving system for a vehicle according to a ninth embodiment of the present invention.

In the motor driving circuit 19, as in the eighth embodiment, the stationary contact 86*a* of the lock relay circuit 82 is connected to the connecting terminal 84*c* and the stationary contact 86*b* is connected to the connecting terminal 84*d*. In operation of the super-locking, the connecting terminals 84*c* and 84*d* are connected to a plus terminal of a direct current source and the terminals 84*a* and 84*b* are connected to a minus terminal of the direct current source (as shown in the fourth line of the table designated as SUPER-LOCKING in FIG. 33) so that the electric motor is energize to rotate cam 25 clockwise in FIG. 1.

Figure 34:
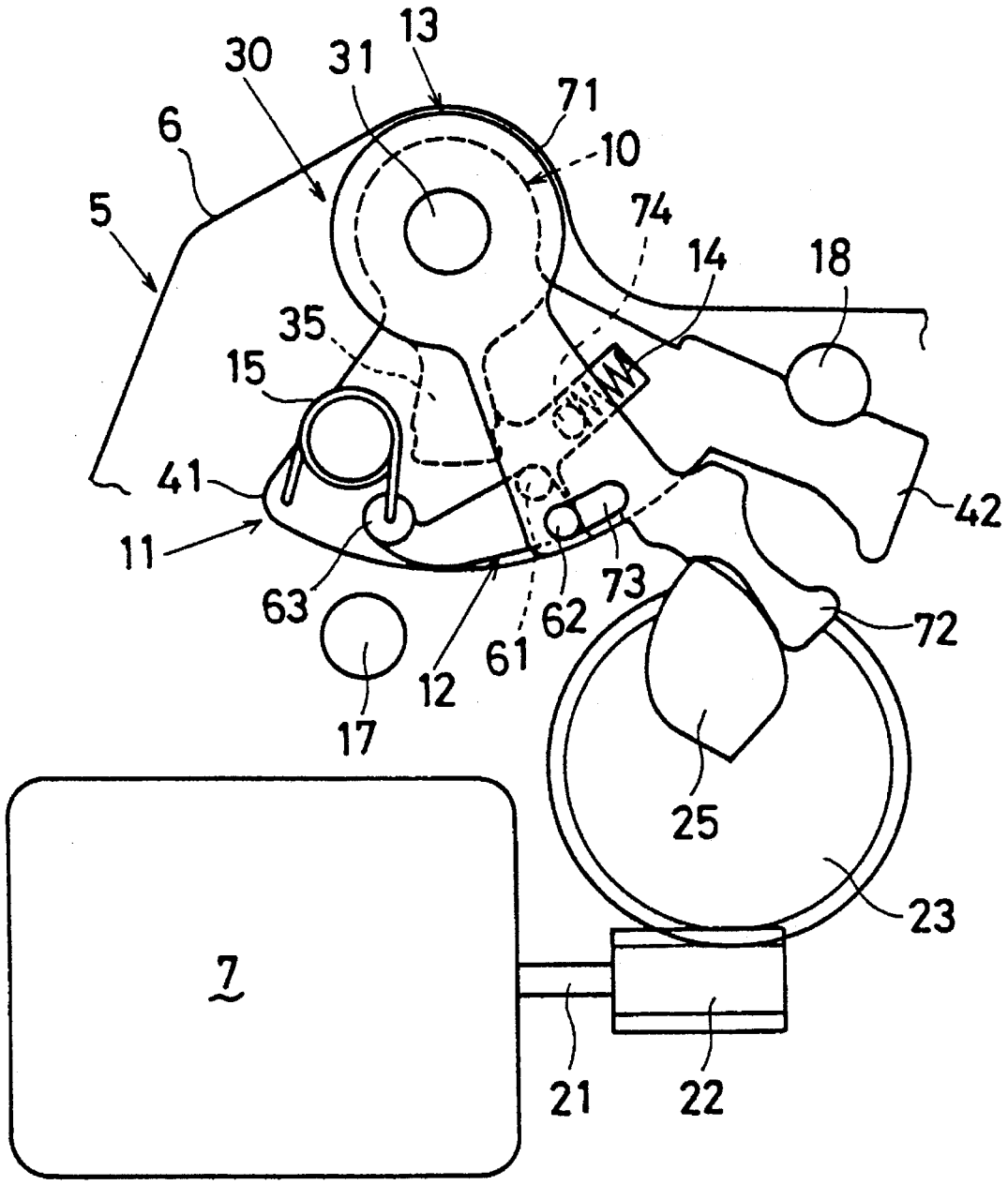
FIG. 34 is a plan view illustrating a main portion of a clutch mechanism of an actuator used in a door-lock driving unit according to a tenth embodiment of the invention.

FIG. 34 illustrates a clutch mechanism of an actuator of a door-lock driving system for a vehicle according to a tenth embodiment of the present invention. The stopper spring 16 described in the first embodiment is a shock absorbing member for the elongation 72 of the cam 25 and the clutch lever 13. Therefore, if there is no trouble of strength or collision sound in parts or components of the cam 25 and the clutch lever 13, the stopper spring 16 is omitted in this embodiment. As a result, the number of parts is reduced and the holding groove 57 which was formed for the stopper spring on the base portion and on the surface of the elongation of the output lever 11 (in the first embodiment) is eliminated, thereby reducing the production cost.

In the above embodiment, the actuator is operated to toggle between the unlocking state, the locking state or the super-locking state by operating a key. However, the shifting may be carried out by some other member such as centralized door-lock switches or a remote control switch, etc.. By the way, the present invention may be adopted to locking and unlocking of a trunk lid of a car, doors for a vehicle other than the automobile or doors for a building.

In the above embodiment, the clutch arm 12 is molded integral with a resinous material into a designated unit shape, however, a clutch arm composed of a plurality of parts is also available. In the above embodiment, the return spring 14 is used as a biasing member, however, a member made of elastic resinous material such as synthetic rubber, plastic material or the like or a member made of resilient metal like a leaf spring are also available as the biasing member or the snap member. A member made of elastic resinous material such as synthetic rubber or plastic material, a member made of resilient metal like a leaf spring or an air cushion is also available as a shock absorbing member for the stopper spring.

In the preceding embodiments, a single-locking side stopper 18 is used as a locking-side rotation stopper, however, a plurality of rotation stoppers located different rotational position for the output lever 11 and the clutch lever are also available. The shape of the output lever 11 is not limited to a sector but annular, elliptic or triangular shape is also applicable. Other shapes of the clutch lever 10, clutch arm 12 and the clutch lever are also not limited to the above embodiments.

In the above embodiments, the actuator is arranged so that the unlocking state is carried out when the input lever (first lever) 10, the output lever (second lever) 11 and clutch lever 13 rotate clockwise around the pivot 31 and the locking state (or super-locking state) is carried out when they rotate around the pivot counterclockwise. However, the actuator may be arranged so that the locking state ( or super-locking state) is carried out when they rotate clockwise around the pivot 31 and the unlocking state is carried out when they rotate counterclockwise around the pivot 31.

In the above embodiments, the input lever (first lever) 10 and the clutch lever 13 rotate together around the common pivot 31 of the output lever (second lever) 11, however, it is possible that each member rotates around each separate pivot.

Of course, one of the input lever (first lever) 10, the output lever (second lever) 11, the clutch arm 12 or the clutch lever 13 may be made from a plurality of members.

In the foregoing discussion of the present invention, the invention has been described with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than a restrictive, sense.

What is claimed is:

1. A door-lock driving system including a door-lock unit to unlock and lock a door, a manual member manually operating said door-lock unit and an actuator controlling said door-lock unit for establishing a door-unlocking state, an ordinary door locking state or a super-locking state; wherein said actuator comprises:

a case;

a common pivot secured to said case;

an electric motor disposed in said case;

a torque transmitting means disposed in said case and connected to said electric motor for transmitting driving torque of said electric motor;

a first lever connected to said manual member and disposed in said case to be rotatable around said pivot;

a second lever disposed on said first lever to be rotatable relative to said first lever on an axis of said pivot and connected to said door-lock unit and, said second lever having a first torque receiving portion which is engaged with said torque transmitting means when said torque transmitting means rotates in a direction to establish said ordinary locking state and a locking-side portion which engages said first lever when said unlocking state or said ordinary locking state is established;

a clutch arm pivotally supported by said second lever and engages said first lever when the unlocking state or said ordinary locking state is established;

a clutch lever disposed to be rotatable relative to said second lever and said clutch arm on said axis of said pivot and having a second torque receiving portion which is engaged with said torque transmitting means when said torque transmitting means rotate in the direction to establish said unlocking state and when said torque transmitting means rotates in the direction to establish said super-locking state, and a driving member which drives said clutch arm to disengage from said first lever only when said torque transmitting means engages said second torque receiving portion to rotate in the direction to establish said locking state relative to said second lever and said clutch arm.

2. A door-lock driving system according to claim 1, wherein:

said second torque receiving portion of said clutch lever extends from a circumference of said second lever toward said torque transmitting means.

3. A door-lock driving system according to claim 1, further comprising:

an unlocking-side stopper engageable with said clutch lever when said clutch lever is located in said unlocking state, and a locking-side stopper engageable with said second lever when said clutch lever is located in said ordinary locking state.

4. A door-lock driving system according to claim 3, further comprising:

a movable contact secured to said second lever, a stationary contact, disposed in said case to face said movable contact, for supplying electric current to said electric motor when said second lever rotates and interrupting the current when said second lever is in abutment with said locking-side stopper.

5. A door-lock driving system according to claim 1, wherein said driving member comprises a snap member for biasing said clutch arm during said unlocking state or said first locking state against said first lever and for biasing said clutch arm during said super-locking state to disengage said first lever.

6. A door-lock driving system according to claim 1, wherein said actuator further comprises an engagement member having an opening disposed between said clutch arm and said clutch lever.

7. A door-lock driving system according to claim 6, wherein said actuator further comprises a spring member, disposed between said second lever and said clutch lever, for biasing said clutch arm against said first lever through said clutch lever.

8. A door-lock driving system including a manual control member, a door lock unit for locking and unlocking a door; an actuator for controlling said door-lock unit to establish a door unlocking state, a first locking state in which the door may be unlocked by operating said manual control member and a second locking state in which the door can not be unlocked by operating said manual control unit and instruction means for generating a signal instructing one of said states; wherein said actuator comprises:

an electric motor generating driving torque when it is energized;

a torque transmitting means engaged with said electric motor for transmitting said driving torque of said electric motor;

a lever mechanism connected to said manual control unit and door-lock unit and rotated by said torque transmitted by said torque transmitting means;

a clutch member for interrupting the torque transmission between said door-lock unit and said lever mechanism when said first locking state is shifted to said second locking state, and a motor energizing unit for generating a signal to stop energizing said electric motor when said unlocking state is shifted to said first locking state according to a change-over signal generated by said instruction means and for generating a signal to energize said electric motor when said first locking state is shifted to said second locking state according to a change-over signal generated by said instruction means.

9. A door-lock driving system according to claim 8, wherein:

said clutch member has a clutch lever disposed to be rotatable relative to said lever mechanism and a clutch arm pivotally supported by said lever mechanism.

10. A door-lock driving system according to claim 9, further comprising:

an unlocking-side stopper engageable with said clutch lever when said clutch lever is located in an unlocking state, and a locking-side stopper engageable with said lever mechanism when said clutch lever is located in a locking state.

11. A door-lock driving system according to claim 10, further comprising:

a case;

a movable contact secured to said lever mechanism, a stationary contact, disposed in said case to face said movable contact, for supplying electric current to said electric motor when said lever mechanism rotates and interrupting the current when said lever mechanism is in engagement with said locking-side stopper.

12. A door-lock driving system according to claim 9 wherein said clutch member further includes a snap member for biasing said clutch arm during said unlocking state or said first locking state against said lever mechanism and for biasing said clutch arm during said second locking state to disengage said clutch lever.

13. A door-lock driving system according to claim 9, wherein said actuator further comprises an engagement member having an opening disposed between said clutch arm and said clutch lever.

14. A door-lock driving system according to claim 13, wherein said actuator further comprises a spring member, disposed between said lever mechanism and said clutch lever, for biasing said clutch arm against said lever mechanism through said clutch lever.

* * * * *